US009743765B2

(12) United States Patent
Lawson

(10) Patent No.: US 9,743,765 B2
(45) Date of Patent: Aug. 29, 2017

(54) CUSTOMIZABLE MODULAR STORAGE UNIT ORGANIZER APPARATUS, SYSTEM AND METHOD OF USING SAME

(71) Applicant: Stephen John Lawson, Surrey (CA)

(72) Inventor: Stephen John Lawson, Surrey (CA)

( * ) Notice: Subject to any disclaimer, the term of this patent is extended or adjusted under 35 U.S.C. 154(b) by 0 days.

(21) Appl. No.: 14/631,719

(22) Filed: Feb. 25, 2015

(65) Prior Publication Data

US 2015/0164223 A1 Jun. 18, 2015

Related U.S. Application Data

(63) Continuation-in-part of application No. 13/933,486, filed on Jul. 2, 2013, now abandoned.

(51) Int. Cl.

| | |
|---|---|
| ***A47B 88/04*** | (2006.01) |
| ***A47B 61/00*** | (2006.01) |
| ***A47B 88/90*** | (2017.01) |
| ***A47B 88/40*** | (2017.01) |
| *A47B 61/02* | (2006.01) |

(52) U.S. Cl.

CPC ..... *A47B 88/04* (2013.01); *A47B 61/003* (2013.01); *A47B 88/40* (2017.01); *A47B 88/941* (2017.01); *A47B 61/02* (2013.01); *A47B 2210/01* (2013.01); *Y10T 29/49876* (2015.01)

(58) Field of Classification Search

CPC ..... A47B 88/04; A47B 88/0014; A47B 61/02; A47B 61/003; A47B 2088/202; A47B 88/40; A47B 88/941

USPC ..... 312/334.1, 334.7, 334.8, 334.13, 348.3, 312/350; 211/94.01, 94.02, 94.03, 162

See application file for complete search history.

(56) References Cited

U.S. PATENT DOCUMENTS

| | | | | |
|---|---|---|---|---|
| 5,466,061 | A * | 11/1995 | Lautenschlager | A47B 88/00 312/184 |
| 6,007,172 | A * | 12/1999 | Shufelt | A47B 88/04 312/234 |
| 6,935,519 | B2 * | 8/2005 | Lawson | A47F 7/24 211/94.02 |
| 7,210,659 | B2 * | 5/2007 | Lawson | D06F 95/004 211/46 |
| 7,988,245 | B2 * | 8/2011 | Machala | A47B 61/02 312/286 |
| 2003/0184198 | A1 * | 10/2003 | Bodingbauer | A47B 88/20 312/348.3 |
| 2007/0273258 | A1 * | 11/2007 | Ernst | A47B 88/20 312/348.3 |
| 2008/0231155 | A1 * | 9/2008 | Shen | A47B 88/90 312/334.8 |

(Continued)

*Primary Examiner* — James O Hansen

(74) *Attorney, Agent, or Firm* — Palmer IP

(57) ABSTRACT

A customizable modular storage unit organizer apparatus with a pair of slides, a pair of slide covers, a pair of cross bars, a pair of retainer clips, and a container for storing articles within the apparatus. The cross bars extend between, are affixed to the slide covers, and have two distal ends, top, bottom, first and second side portions, a slot extending longitudinally along the length of the exterior surface of cross bars for accommodating attachments. The retainer clips allow the slide covers to be selectively, repeatedly, and releasably retained to the slides. The size of the enclosure formed between the slide covers and cross bars may be modified by adjusting the positions of the cross bars on the slide covers.

30 Claims, 17 Drawing Sheets

(56) References Cited

U.S. PATENT DOCUMENTS

2012/0248955 A1* 10/2012 Rehage ..... F24C 15/168
312/334.1

* cited by examiner

CUSTOMIZABLE MODULAR STORAGE UNIT ORGANIZER APPARATUS, SYSTEM AND METHOD OF USING SAME

1. CROSS REFERENCE TO RELATED APPLICATIONS

This application is a continuation-in-part, and claims priority, to U.S. patent application Ser. No. 13/933,486, filed Jul. 2, 2013, and now abandoned, entitled "CUSTOMIZABLE MODULAR STORAGE UNIT ORGANIZER APPARATUS, SYSTEM AND METHOD OF USING SAME", which is incorporated herein by reference, in its entirety.

2. TECHNICAL FIELD

The present invention generally relates to an apparatus, system, and method for customizing a modular storage unit organizer and components, and more particularly, for a customizable storage cabinet or closet organizer and component apparatus, system, and method of using the same.

3. BACKGROUND OF THE INVENTION

Organizer systems and components are commonly used to organize articles such as jewelry, clothing, shoes, socks, ties and other objects in closets and cabinets. Known systems are manufactured integrally for closet and cabinet systems, or involve organizers which telescope to fit a range of cabinet sizes. These systems may be bulky, and the depth and type of component attached to the organizer is often fixed. The organizers may be welded, screwed or otherwise attached together in a rigid manner, tend to be heavy and bulky in construction and unable to be customized in the field. Therefore, there is a need for a customizable, modular storage unit and organizer apparatus, system and method that provides components that can be easily and removeably interconnected and assembled in multiple combinations and orientations and in a lightweight, low profile, adjustable and efficient manner.

According to one aspect, the present invention provides such an apparatus and system for arranging and storing articles in a customizable, modular and removable organizer system with interlocking components to contain and organize items including but not limited to shoes, clothing, and accessories in a limited space, such as a cabinet or a closet.

According to one aspect, the present invention allows for an assembler, to assemble a variety of organizers in different widths and configure the organizers with different inserts, such as baskets, hampers, or the like, before shipment to end users, in order to minimize inventory by storing in inventory only a selection of components that can be configured into a large assortment of end products for the customer. Also according to one aspect, the cross bars of the present invention may be cut to any desired length before assembly and optionally punched multiple times before anodizing. The organizer may be configured, cut, and/or assembled at any desired location.

4. SUMMARY OF THE INVENTION

One embodiment of the present invention is directed to a customizable storage unit organizer apparatus comprising a plurality of slides, a plurality of slide covers disposed on top of the slides, a plurality of hollow cross bars extending between and affixed to the plurality of slide covers, and a plurality of retainer clips for selectively, repeatedly, and releasably retaining the slide covers to the slides. Each slide may comprise a recess that is configured to interact with the retainer clip for receiving the clips when attached to a slide cover.

Each slide cover may comprise first and second distal ends, exterior and interior surfaces, a first and second side portions, a curvilinear top portion, a bottom portion, a plurality of flanges disposed on and extending longitudinally along the interior surface, a slide cover divider extending between the first and second side portions, the slide cover comprising a slide cover slot, a chamber formed between the top portion, the second portion, and the slide cover divider.

Each of the cross bars comprises first and second distal ends, top, bottom, first and second side portions, a first slot extending longitudinally along the length of the exterior surface of cross bars for accommodating attachments. The cross bars are fastened to the slide covers such that the slide covers and cross bars are oriented in a perpendicular manner with respect to one another, forming a rectangular shaped enclosure between the slide covers and cross bars. The size and shape of this enclosure may be modified by adjusting the position of the cross bars along the length of the slide covers. A cabinet component or holding unit, such as a container, is placed within the enclosure for storing articles.

In another embodiment, a kit for a customizable storage unit organizer apparatus comprises a pair of slides, a pair of slide covers, and a pair of hollow cross bars, a pair of retainer clips, end caps, and a cabinet component, as described above.

In another embodiment, the method of using the apparatus or the kit of the present invention includes manufacturing pairs of sub-slide covers and sub-cross bars from one elongate slide cover and one elongate cross bar, respectively, arranging the pair of sub-cross bars in a parallel configuration, arranging the one of the sub-slide covers on one end of the parallel configuration such that the pair of sub-cross bars intersect the sub-slide cover at a right angle, arranging the position of the other sub-slide cover of the pair of sub-slide covers at another end of the parallel configuration such that the pair of sub-cross bars intersect the other sub-slide cover at a right angle, and fastening the sub-cross bars to the sub-slide covers. This forms an enclosure between the pair of sub-cross bars and the pair of sub-slide covers. The method also includes placing a retainer clip into each slot on each divider in each slide cover, snapping the pair of sub-slide covers into the pair of slides, and customizing the size of the enclosure by changing the positions of the pair of sub-cross bars along the length of the slide members, if desired.

Further advantages of the invention will become apparent when considering the drawings in conjunction with the detailed description.

5. BRIEF DESCRIPTION OF THE DRAWINGS

The device and method of using the device according to several embodiments of the present invention will now be described with reference to the accompanying drawing figures, in which.

Like reference numerals refer to corresponding parts throughout the several views of the drawings.

6. DETAILED DESCRIPTION

The following detailed description of the invention is merely exemplary in nature and is not intended to limit the invention or the application and uses of the invention. A customizable, modular storage unit organizer apparatus, system, and method is provided. The present invention in several embodiments provides a customizable, modular organizer system, composed primarily of extruded aluminum channels, which can be cut and fitted by local assembly shops rather than requiring assembly at the point of manufacture. This enables space efficient shipments and stocking in destination countries with modular components that can be shipped to the customer location, and then quickly assembled into the preferred configuration for the end customer, while retaining a wide selection of modular options. Components are reversible and adjustable in width, with interchangeable sub-components, in order to provide a high-end closet or cabinet organizer system to house interchangeable bins, trays, baskets and drawers.

Figure 1:
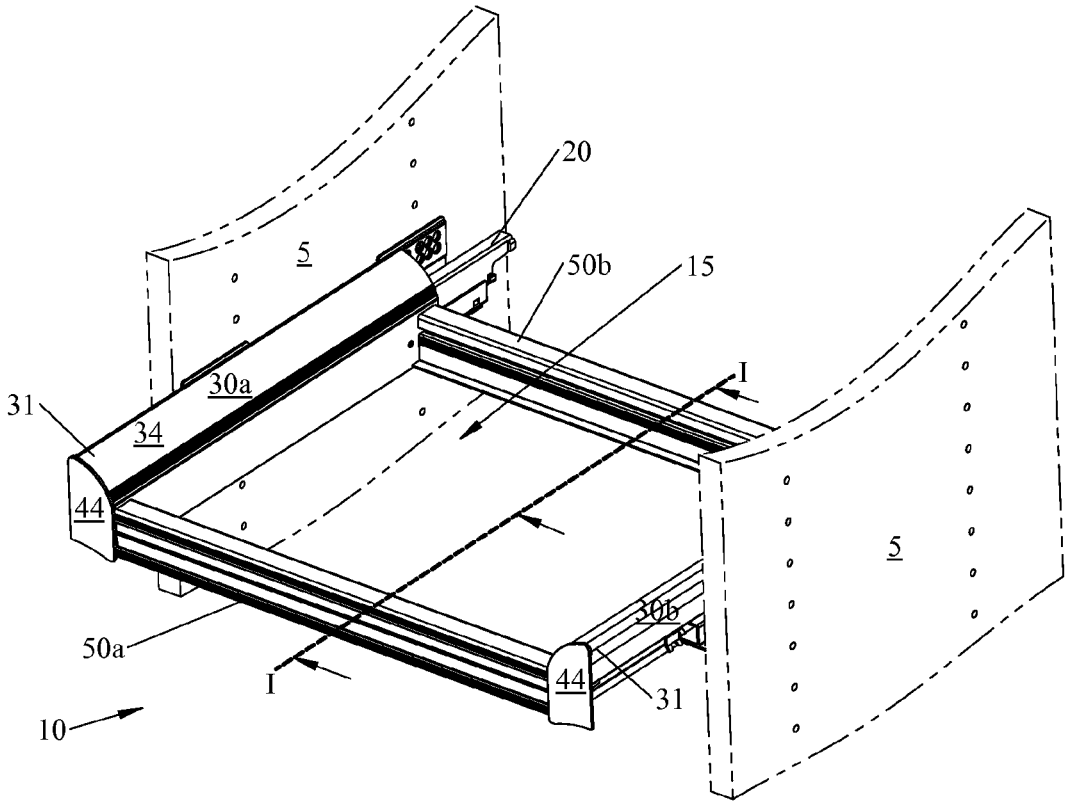
FIG. 1 illustrates a perspective view of the unit organizer apparatus in accordance with an embodiment of the invention.

The storage unit organizer apparatus 10 in accordance with an embodiment of the invention is illustrated in perspective in FIG. 1. In a cabinet or closet or other enclosure having walls 5, slides 20 are mounted on the level, one slide 20 on each side of the cabinet enclosure for each drawer or other cabinet component (not shown here). In an embodiment, the slides 20 may be left or right hand dedicated. Slide mechanisms 20 may include a euro-roller, friction slide, ball bearing slide, and soft-close undermount slide, but other slides may be employed in combination with the present invention. A cabinet may typically have a plurality of pairs of slides 20 mounted on the interior cabinet walls 5 adapted to receive multiple organizers 10.

Slide covers 30 are disposed on top of the each slide 20. At least two hollow cross bars 50 extend between, and are affixed to, each slide cover 30. Each slide cover 30 extends longitudinally between the ends of the cross bars 50. A raised tab 22 (not shown here) is formed on the top rear surface of the slide 20 to receive the underside of the slide cover 30. While a metal tab 22 typically extends in a direction transverse to the longitudinal slide, for the present invention, a tab 22 projecting longitudinally to the slide 20 is employed. The front end (proximal to the front opening of the cabinet) of the slide 20 receives a retainer clip 70 (not shown here) for selectively, repeatedly, and releasably retaining the slide cover 30 to the slide 20. Alternatively, the slide covers 30 may be secured to the slides by a mechanical fastener (not shown), such as a threaded or unthreaded fastener, including but not limited to a screw or weld.

An organizer enclosure 15 is formed between the slide covers 30 and cross bars 50. End caps 44 may be disposed on the front ends of the slide covers 30, and a cabinet component for storing articles may be placed within the enclosure 15 or on the cross bars 50 surrounding the enclosure.

In an embodiment, the unit comprises two slide covers 30*a*, 30*b* and two cross bars 50*a*, 50*b*. Each slide cover 30*a*, 30*b* comprises two distal ends 31. As the slide cover 30 may be reversible, it is not necessary to determine a "front" and "rear" end. The cross bars 50*a*, 50*b* extend longitudinally between the ends 31 of the slide covers.

Figure 2:
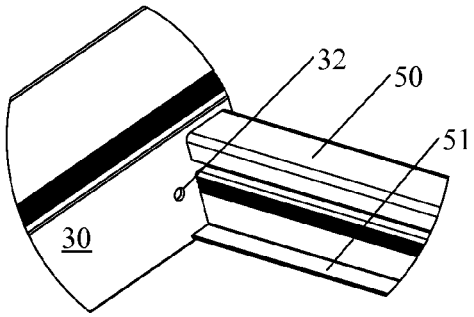
FIG. 2 illustrates a close-up, side perspective view of the intersection of the slide cover and cross bar of the apparatus of FIG. 1 in accordance with an embodiment of the invention.

FIG. 2 illustrates a close up side view of an intersection of the cross bar 50 with the slide cover 30 from the perspective of the organizer enclosure 15, also showing hole 32 in the slide cover 30 for alternate location of the cross bar 50 in relation to the slide cover 30. In an embodiment, the slide cover 30 may comprise a series or plurality of holes 32 in order to provide multiple alternate locations of the cross bar 50 in relation to the slide cover 30.

In an embodiment, the cross bars 50 are horizontally adjustable along the length of the slide covers 30, which permits size of the organizer enclosure 15 to be selectively adjusted according to a user's preference or needs, thereby maximizing space. The cross bar 50 may be fixed to the slide cover 30 using any known method or device known in the art for affixing structural members to one another, including but not limited to a fastener, a weld, or an adhesive, such as an epoxy. In an embodiment, the slide covers 30 comprise a plurality of through holes 32 disposed along the length of the slide covers 30. The through holes 32 are sized to receive a fastener (not shown), including but not limited to a screw, projecting from each distal end of the cross bar 50.

Referring to FIG. 1 and additionally to FIGS. 3-5, 10-13, the slide covers 30 are sized to fit over the slides 20, while providing a narrow profile in order to maximize the space available for cabinet components. In an embodiment, the slide covers 30 are identical in size, shape, and design to one another such that, for example, two separate slide covers 30 used in the apparatus may be cut on site from a single, long slide cover. For example, one single, long slide cover may be cut into multiple pieces of any desirable length, creating multiple slide covers 30. This avoids the need to expend resources designing, manufacturing, storing, and transporting separate slide cover designs for each separate slide cover used in the apparatus because only one slide cover would need to be designed, manufactured, transported, and stored. The slide cover 30 may then be cut into multiple slide cover pieces of lengths appropriate for a particular cabinet. Additionally, the slide covers 30 can be reoriented and used for the slide covers 30 on each side of the apparatus. In this embodiment, when, reoriented, and installed in the apparatus, the cross sectional design and shape of the slide covers 30 are mirror images of one another. The slides 20 may be any type of slide known in the cabinetry or storage unit organizer art including but not limited to standard stock slides 20 for cabinetry or drawer organizers.

Referring to FIG. 2, low profile slide covers 30 are disclosed which attach to various slides 20, including the relatively new soft close under mounted slides 20. Cross bars 50 are disclosed which are adjustably installed, and have multiple permutations providing for a variety of components to be mounted or placed thereon, and to maximize the closet space. FIG. 2 illustrates an embodiment where the slide cover 30 comprises three through holes 32 (of which one is shown) and the cross bar is fixed to the slide cover 30 by a fastener (not shown) that engages with the through holes 32 disposed along the slide cover 30. As shown in FIG. 2, cross bar 50 has been fixed to slide cover 30 in the outer most position, this expands the size of enclosure 15. In some embodiments, the enclosure 15 may be further narrowed by moving the cross bar 50 to a different position along the slide cover 30, toward the center of the slide cover 30.

Figure 3:
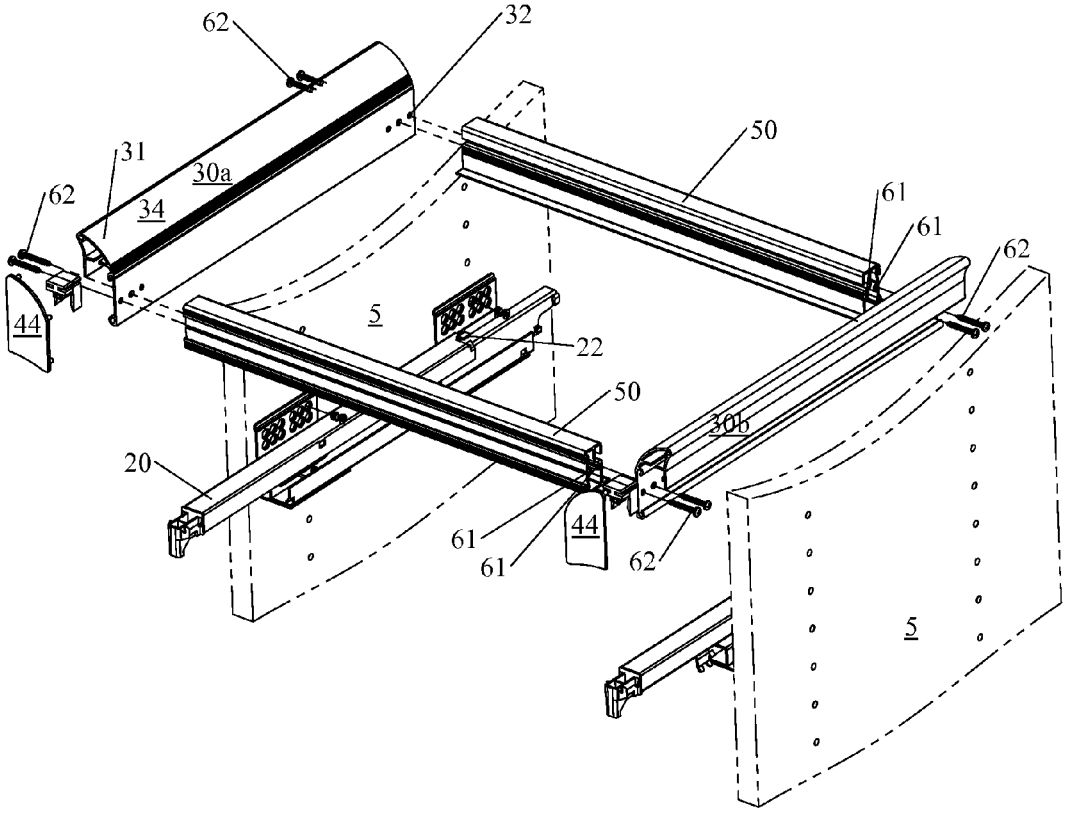
FIG. 3 illustrates an exploded perspective view of the unit organizer apparatus of FIG. 1 in accordance with an embodiment of the invention.

FIG. 3 illustrates an exploded perspective view of the unit organizer apparatus 10 of FIG. 1 in accordance with an embodiment of the invention. As discussed above, a cabinet may typically have a plurality of pairs of slides 20 mounted on the interior cabinet walls 5 adapted to receive multiple organizers 10. The slides 20 may comprise a tab 22 raised on the dorsal surface of the slide 20 and oriented in the lateral or transverse direction adapted to receive a slide cover 30. In an embodiment, the cross bars 50 are affixed to the slide covers 30 through any suitable connection known in the art, including but not limited to a fastener, a weld, a rivet, or an epoxy. In an embodiment, two cross bars 50 are secured at right angles or substantially right angles to two slide covers 30, forming a rectangular-shaped unit. Channel sections 61 may be disposed on the first and second side portions 35, 36 of the cross bars 50 and may be sized to accommodate fasteners 62. The channel section 61 may be threaded or unthreaded. The fastener 62 may also be threaded or unthreaded, or comprise any other type of fastener including but not limited to rivets, bolts, expanding fasteners or the like that engage the channel by frictional contact between the channel and the fastener. In an embodiment, a fastener 62, including but not limited to an threaded screw, engages an unthreaded channel section 61 of the cross bar located at a distal end of the cross bar 50 and a first side portion of the slide cover in order to secure the cross bar to the slide cover 30, such that the channel 61 self-threads upon insertion of the threaded fastener 62 into the channel.

The rectangular-shaped organizer unit 10 forms a rectangular-shaped enclosure 15 in the center of the unit 10. The distance between the cross bars 50 may be selectively modified by adjusting the position of the cross bars 50 along the length of the slide covers 30 in order to modify the size of the enclosure 15. Specifically, in an embodiment, the size of the rectangular-shaped enclosure 15 may be decreased or narrowed by moving the cross bars 50 closer to one another along the length of the slide covers 30 and re-fastening the cross bars 30 at the new, desired location. This adjustability permits the size of the enclosure 15 to be modified, in order to accommodate different sized containers (not shown) for storing articles in the apparatus. The single walled design of the slide covers 30 allows for simple one point attachment between the covers 30 and the cross bars 50.

Figure 4:
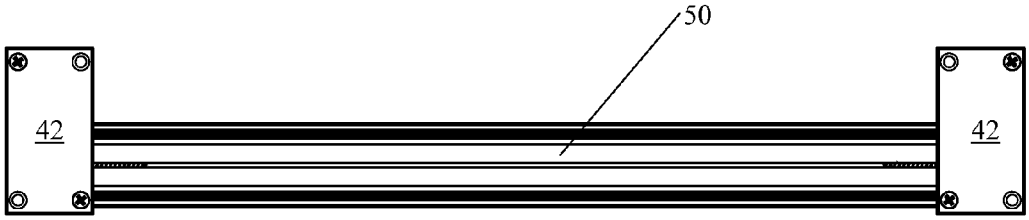
FIG. 4 illustrates a front view of the unit organizer apparatus of FIG. 1 with face plates in accordance with an embodiment of the invention.

FIG. 4 illustrates a front view of the unit organizer apparatus of FIG. 1 with face plates 42 in accordance with an embodiment of the invention. Face plates 42 may be used to cap the slide cover 30, which can receive a board or other covering as desired by the customer.

Figure 5:
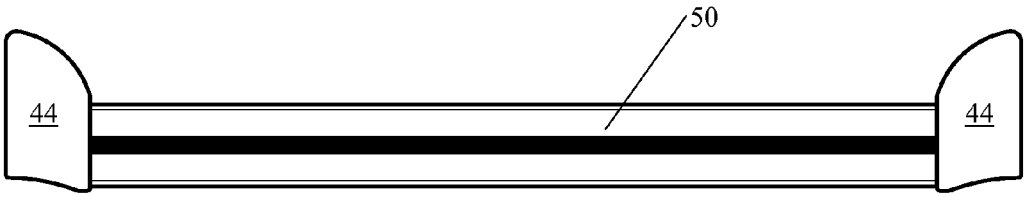
FIG. 5 illustrates a front view of the unit organizer apparatus of FIG. 1 with end caps in accordance with an embodiment of the invention.
Figure 6:
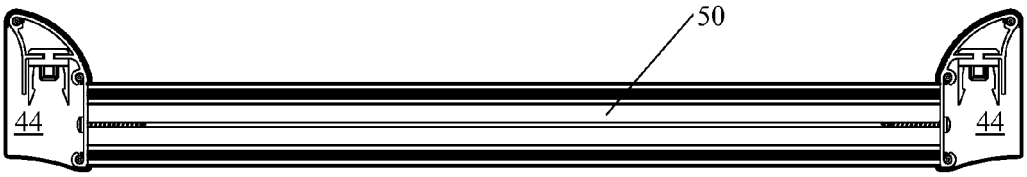
FIG. 6 illustrates a rear view of the unit organizer apparatus of FIG. 5 in accordance with an embodiment of the invention.
Figure 50:
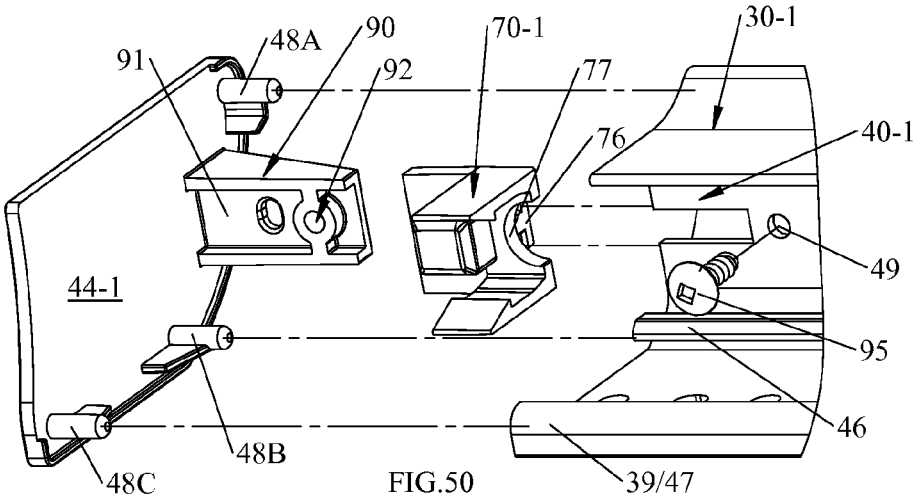
FIG. 50 illustrates an exploded, close-up view of an end cap, a retainer clip and a slide cover in accordance with an embodiment of the invention.

FIGS. 5 and 6 illustrate front and rear views of the unit organizer apparatus 10 of FIG. 1, respectively, with end caps 44 in accordance with an embodiment of the invention. End caps 44 have an interior (not shown) and exterior surface and may be of the same profile as the cover 30. End caps 44 may have pegs, spigots, guide posts, projections 48 or the like, extending substantially perpendicularly from the interior surface which interface with screw channels 45, 46, 47 of slide cover 30. In another embodiment, end caps 44 may have projections 48 which interface with the screw channels 45, 46, 47 and a tang 90 (As shown in FIG. 50) which interface with slide cover chamber 41.

Figure 7:
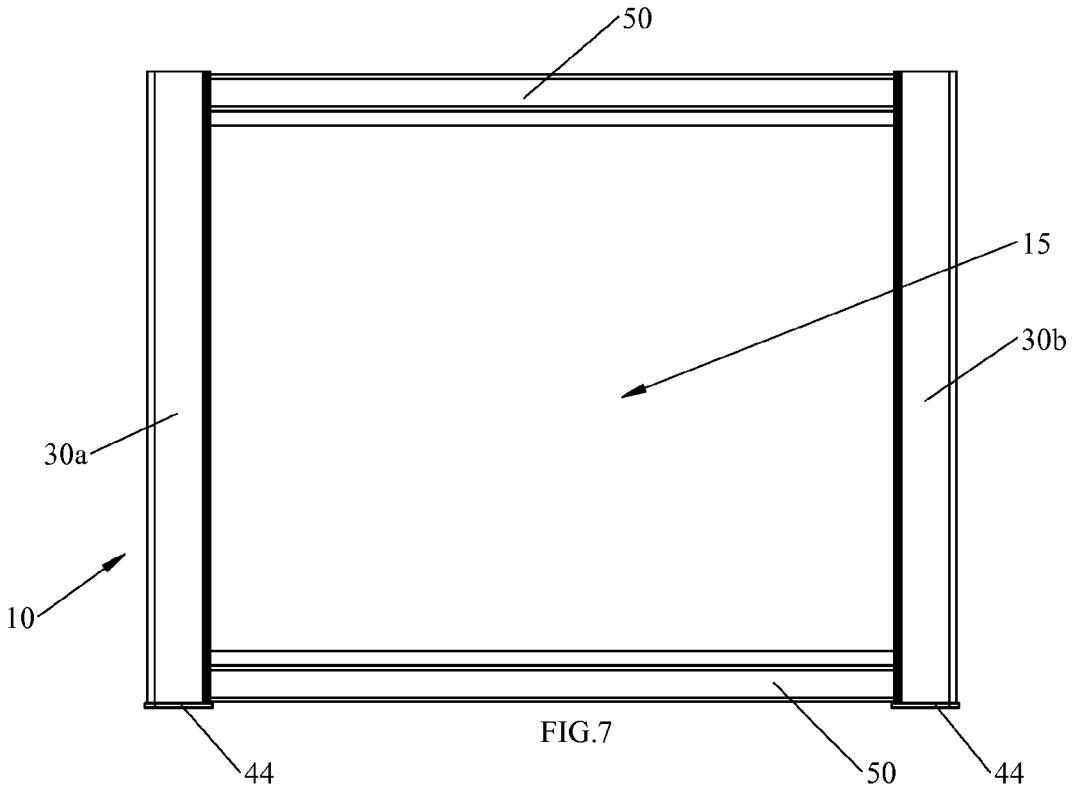
FIG. 7 illustrates a top view of the unit organizer apparatus of FIG. 1 in accordance with an embodiment of the invention.
Figure 8:
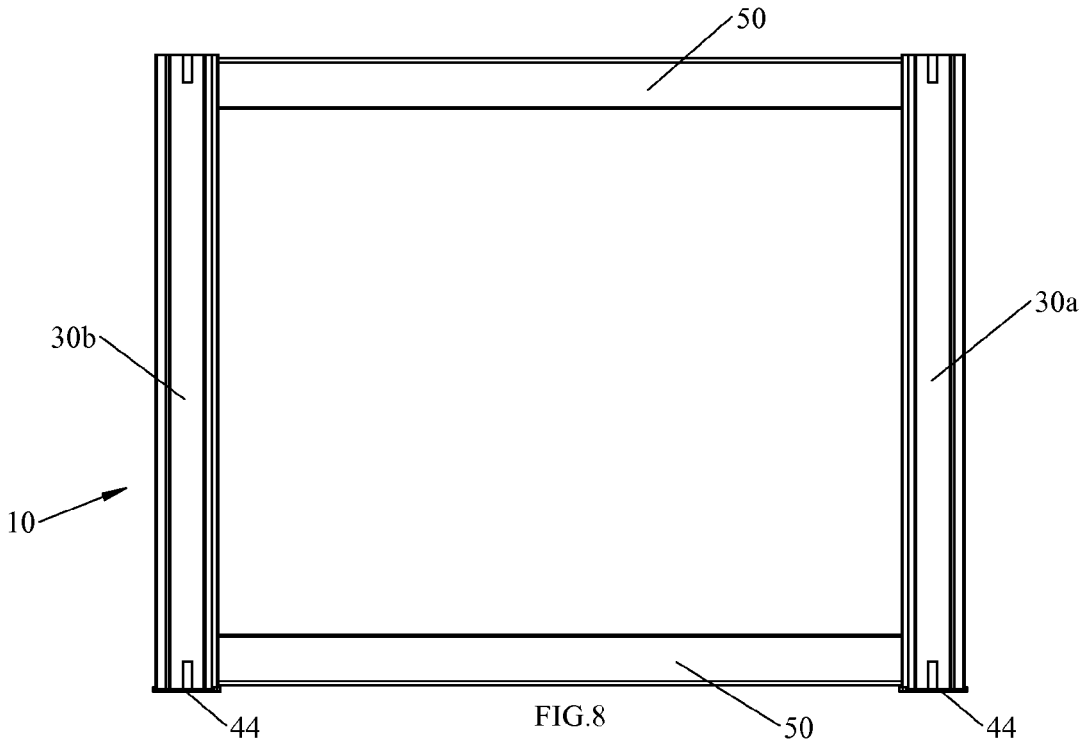
FIG. 8 illustrates a bottom view of the unit organizer apparatus of FIG. 1 in accordance with an embodiment of the invention.

FIGS. 7 and 8 illustrate top and bottom views of the unit organizer apparatus of FIG. 1 in accordance with an embodiment of the invention with the cross bars 50 affixed to a furthermost or outermost portion on the distal ends 31 of the slide covers 30.

Figure 9:
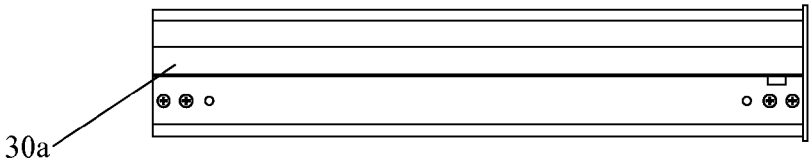
FIG. 9 illustrates a first side view of the unit organizer apparatus of FIG. 1 in accordance with an embodiment of the invention.
Figure 10:
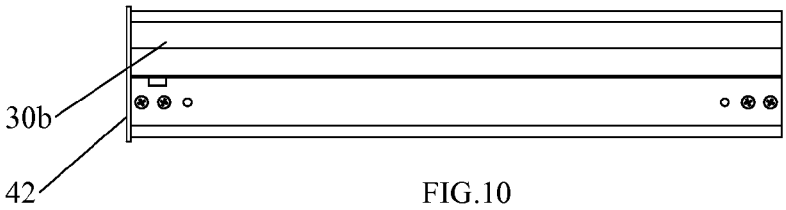
FIG. 10 illustrates a second side view of the unit organizer apparatus of FIG. 1 in accordance with an embodiment of the invention.
Figure 11:
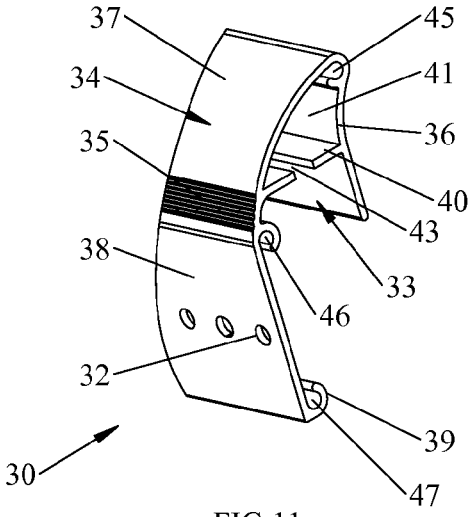
FIG. 11 illustrates a top, perspective, close-up view of the slide cover on the second side of the apparatus of FIG. 1 in accordance with an embodiment of the invention.
Figure 12:
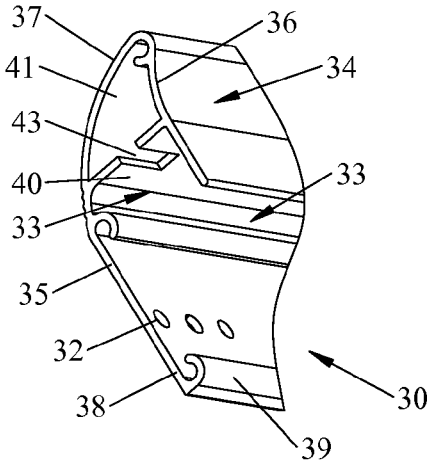
FIG. 12 illustrates a bottom, perspective, close-up view of the slide cover on the second side of the apparatus of FIG. 1 in accordance with an embodiment of the invention.
Figure 13:
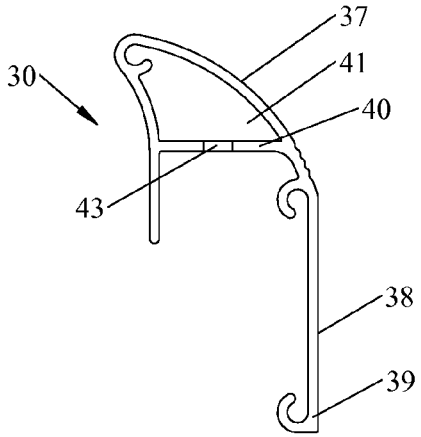
FIG. 13 illustrates a front, close-up view of the slide cover on the first side of the apparatus of FIG. 1 in accordance with an embodiment of the invention.
Figure 14:
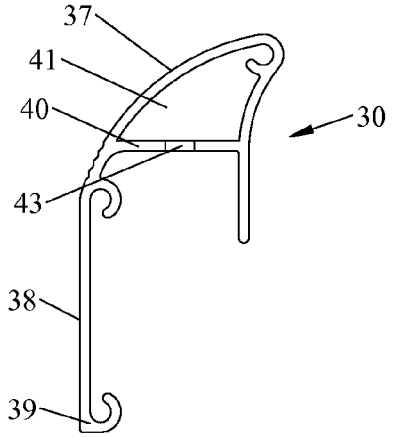
FIG. 14 illustrates a front, close-up view of the slide cover on the second side of the apparatus of FIG. 1 in accordance with an embodiment of the invention.

FIGS. 9 and 10 illustrate first and second side views of the unit organizer apparatus 10 of FIG. 1, respectively, in accordance with an embodiment of the invention, with the cross bars 50 affixed to the slide covers 30 using fasteners 62.

FIGS. 11-14 illustrate perspectives and end views of the slide cover 30. In an embodiment, the slide cover 30 comprises interior 33 and exterior surfaces, first 35 and second 36 side portions, a curvilinear top portion 37, a bottom portion 38, a plurality of slide cover flanges 39, a slide cover divider 40, and a slide cover chamber 41. The slide cover chamber 41 is the enclosed space that formed by the intersection of the second portion 36, the top portion 37, and the slide cover divider 40. The flanges 39 are disposed on and extend longitudinally along the interior surface 33 of the slide cover 30. The slide cover 30 has a first side wall 35 that forms the exterior side wall of the cover 30, and when installed receives the cross bars 50 and faces the interior enclosure 15. This sidewall, in an embodiment, extends from the bottom of the cover 30 to the top. A top portion 37 extends across the top of the cover 30 from the first wall 35, and down the second side portion 36 of the cover 30. In one embodiment, the second wall 36 is shorter than the first wall 35, as it is discontinuous in order to sit about the slide 20 mechanism and inside the slide brackets (not shown). In one embodiment the top portion 37 is curvilinear rendering the top of the cover 30 triangular in cross section, but it may be square, rectangular or other shapes. The first wall surface, particularly at the beginning of the curvilinear portion, may bear grooves or knurling or other features for grip and aesthetically pleasing design, or it may incorporate a channel adapted to receive retaining clips or items to support or partially support cabinet components. The cover 30 may be anodized, painted or otherwise decorated or painted.

In an embodiment, the slide cover 30 has a recess in a flange 39 that is sized to accommodate a retainer clip (not shown) that engages with the slide (not shown) in order to selectively, repeatedly, and releasably retain the slide cover 30 on the slide (not shown). Additionally, the slide (not shown) may have a retaining tab (not shown) at the rear top portion, including but not limited to a tab which is available on a commercially manufactured slide. The tab (not shown) may be rotated 90 degrees such that it protrudes transverse or at 90 degrees to the longitudinal direction of the slide to engage and retain an embodiment of the slide cover 30.

In one embodiment, the slide cover divider 40 has a flat, planar shape and extends between the first 35 and second 36 side portions of the slide cover 30, across the entire width of the interior 33 of the slide cover 30 between the interior surfaces 33 of the first and second side portions 35, 36, and continuous along the length of the cover 30. In an embodiment, there is a recess 43 or notch at the distal ends of the divider 40 that is sized to accommodate the retainer clip 70 (not shown here) and tab 22 (not shown here). In an embodiment, the divider 40 intersects the interior surfaces 33 of the first and second side portions 35, 36 at right angles, as illustrated in FIGS. 11-14. The cover flange 39 extends and curves inwards to form a longitudinally continuous lower screw channel 47, adapted to receive a fastener regardless of the length the cover 30 is cut to. A mid screw channel 46 is disposed longitudinally on the interior 33 of the cover on the interior side of the first wall 35, below but proximate to the divider 40. An upper screw channel 45 is formed at the interior intersection of the top portion 37 and the second wall 36. The screw channels may be used to affix end caps 44 or face plates 42 to the distal ends of the slide covers 30, as desired.

Figure 15:
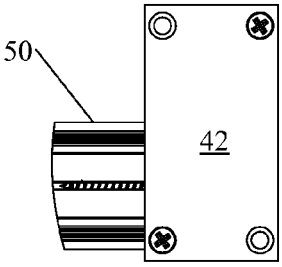
FIG. 15 illustrates a front, close-up view of the face plate of the apparatus of FIG. 1 in accordance with an embodiment of the invention.

FIG. 15 illustrates a front, close-up view of the apparatus of FIGS. 1 and 4 in accordance with an embodiment of the invention. In an embodiment, a face plate 42 may be disposed on and affixed to the front, distal end 31 of the slide cover 30. The shape of the face plate 42 may be rectangular. Alternatively, the face plate (not shown) may extend along the length of the cross bar and span the distal ends 31 of the slide covers 30.

Figure 16:
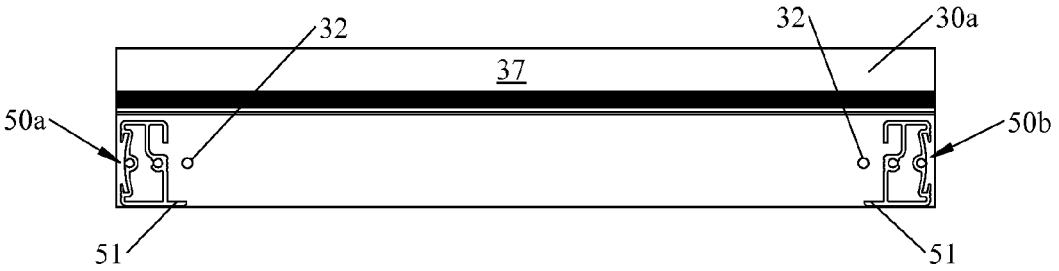
FIG. 16 illustrates a cross sectional side view of the apparatus of FIG. 1 taken along line I-I of FIG. 1 in accordance with an embodiment of the invention.

FIG. 16 illustrates a cross sectional side view of the unit organizer apparatus 10 of FIG. 1 taken along line I-I of FIG. 1 in accordance with an embodiment of the invention. In an embodiment, the cross sections of the slide covers 30 and cross bars 50 used in the apparatus 10 are mirror images of one another when installed in the apparatus 10, as the components are modular and reversible, and as the profile is uniform along the length of the slide covers 30 and cross bars 50. They can also be cut to any desired length in order to create a custom fitted cabinet.

Multiple embodiments of the hollow cross bar 50 may be used in the apparatus 10. For example, the hollow cross bar 50 may have a rectangular cross section or alternatively a step-shaped cross-section. In an embodiment of the hollow cross bar 50 having a rectangular cross section, the cross bar 50 may comprise any combination of a track for accommodating an attachment such as a decorative strip, a slot for accommodating an attachment such as a divider, and a lip or indentation for accommodating a cabinet component, such as a flat shelf, or a cabinet component feature, such as a flange on a shallow tray, all of the above features, or none of the above features. In an embodiment of the hollow cross bar 50 having a step-shaped cross section, the cross bar 50 may comprise any combination of a track for accommodating an attachment such as a decorative strip, a support member such as an indentation or ledge 68, a flange 69 affixed to the top portion of the cross bar 50 and extending over the indentation or ledge 68, a divider dividing the inside of the cross bar 50 into separate upper and a lower chambers, an elongate slot in the bottom portion 55 of the lower chamber for accommodating a retaining piece for a cabinet component, all of the above features, or none of the above features. Various embodiments of the cross bar 50 may comprise any combination of the above features, or alternatively, none of the above features.

In an embodiment, each hollow cross bar 50 comprises first and second distal ends (not shown), a top portion 54*a*, 54*b*, a bottom portion 55*a*, 55*b*, first and second side portions 55*a*, 55*b*, 56*a*, 56*b*, and a side slot (not shown) for accommodating attachments (not shown).

Figure 17:
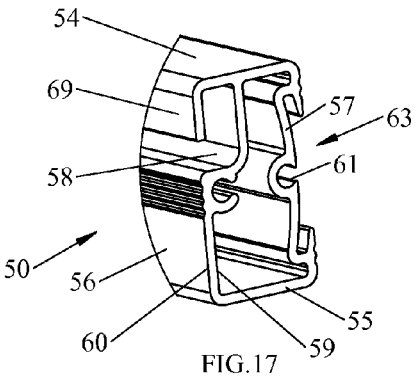
FIG. 17 illustrates a front, perspective, close-up view of the cross bar illustrated in FIG. 1 in accordance with an embodiment of the invention.
Figure 18:
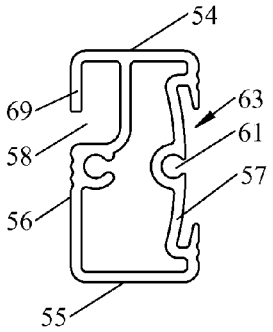
FIG. 18 illustrates a front profile, close-up view of the cross bar illustrated in FIG. 17.
Figure 19:
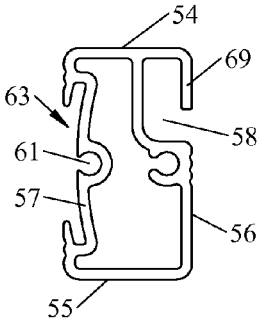
FIG. 19 illustrates a rear profile close-up view of the cross bar illustrated in FIG. 17.

FIGS. 17-19, illustrate an embodiment of the hollow cross bar 50 that comprises first and second distal ends 52, 53, a top portion 54, a bottom portion 55, first and second side portions 55, 56, and a cross bar side slot 58 for accommodating attachments (not shown) for example a divider, a tray, or a container. In an embodiment, the cross bar side slot 58 may be a recess that extends longitudinally along the length of the first side portion 56 of the cross bar and may be sized to accommodate an attachment (not shown). In an embodiment, the cross bar 50 may also have a track 63 on the exterior surface 34 of the second side portion 57 that is sized to accommodate an attachment such as a decorative panel or strip (not shown). In an embodiment, the cross bar 50 may have channel sections 61 that are sized to accommodate fasteners (not shown) and disposed on the inner surface of the first side portions and the outer surface of the second side portion of the cross bar 50, as illustrated in FIGS. 17-19.

Figure 20:
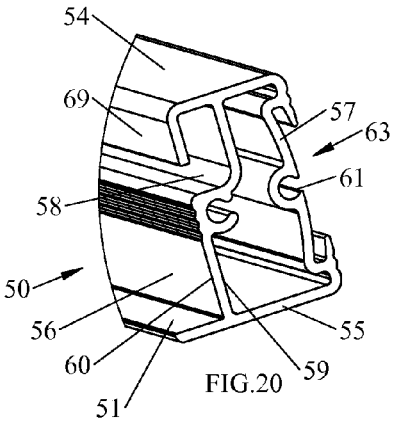
FIG. 20 illustrates a front, perspective, close-up view of the cross bar illustrated in FIG. 17 in accordance with an embodiment of the invention.
Figure 21:
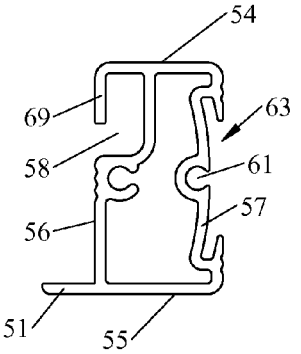
FIG. 21 illustrates a front profile, close-up view of the cross bar illustrated in FIG. 20.
Figure 22:
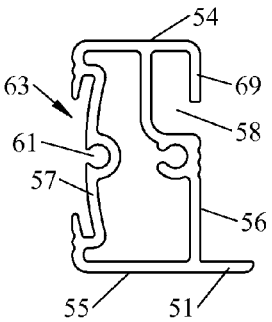
FIG. 22 illustrates a rear profile close-up view of the cross bar illustrated in FIG. 20.

FIGS. 20-22 illustrate an embodiment of the hollow cross bar 50 of FIG. 17, further comprising a lip 51 that extends longitudinally along the length of the cross bar 50 for supporting a cabinet component (not shown), such as a shelf (not shown). In an embodiment, the cabinet component (not shown) may have a flange (not shown) and the lip 51 is adapted to receive the flange of the cabinet component for supporting the cabinet component (not shown). Alternatively, a cabinet component, such as a shelf, may not have a flange and merely rests on top of the lip 51. In an embodiment, the lip 51 extends longitudinally along the length of bottom portion of the exterior surface 34 of each cross bar 50 for supporting the cabinet component. Also in an embodiment, the lip 51 and the first side portion 56 intersect at a right angle and the lip 51 is disposed at the intersection of the first side portion and the bottom portion of the cross bar 50 and projects laterally from the cross bar 50.

Figure 23:
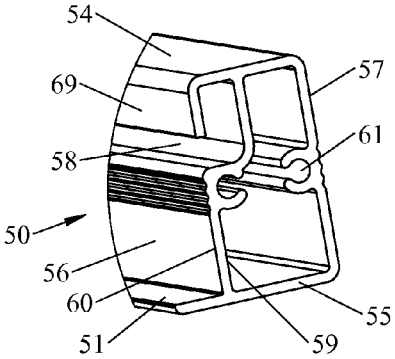
FIG. 23 illustrates a front, perspective, close-up view of the cross bar illustrated in FIG. 17 in accordance with an embodiment of the invention.
Figure 24:
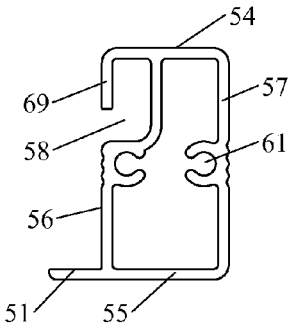
FIG. 24 illustrates a front profile, close-up view of the cross bar illustrated in FIG. 23.
Figure 25:
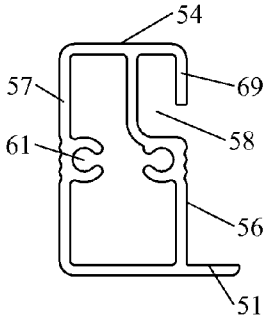
FIG. 25 illustrates a rear profile close-up view of the cross bar illustrated in FIG. 23.
Figure 26:
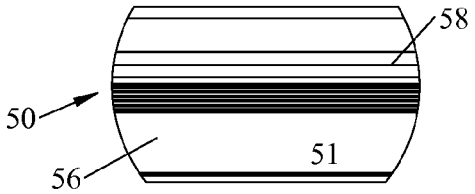
FIG. 26 illustrates a first side, close-up view of the cross bar illustrated in FIG. 23.
Figure 27:
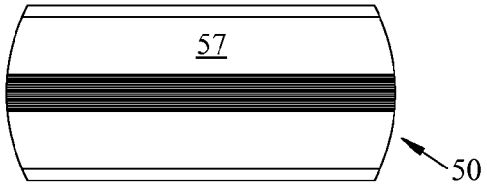
FIG. 27 illustrates a second side, close-up view of the cross bar illustrated in FIG. 23.
Figure 28:
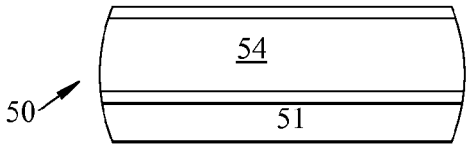
FIG. 28 illustrates a top, close-up view of the cross bar illustrated in FIG. 23.
Figure 29:
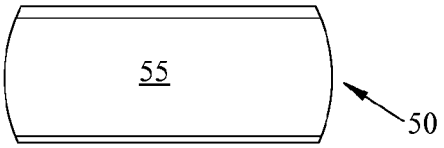
FIG. 29 illustrates a bottom, close-up view of the cross bar illustrated in FIG. 23.

FIGS. 23-25 illustrate an embodiment of the hollow cross bar 50 having a lip 51 of FIG. 20, but without a track.

As illustrated in FIGS. 17-25, the cross bar 50 may optionally have any combination of the lip 51, track 63, and/or side slot 58 for accommodating attachments (not shown). For example, in an embodiment, the cross bar 50 may include none of these features. Alternatively, the cross bar 50 may include a lip 51, a track 63, and a side slot 58 for accommodating attachments (not shown) or any combination thereof.

FIGS. 26-29 illustrate first and second side, top, and bottom views of the embodiment of the cross bar 50 illustrated in FIGS. 23-25 having only a side slot 58 and lip 51.

Figure 30:
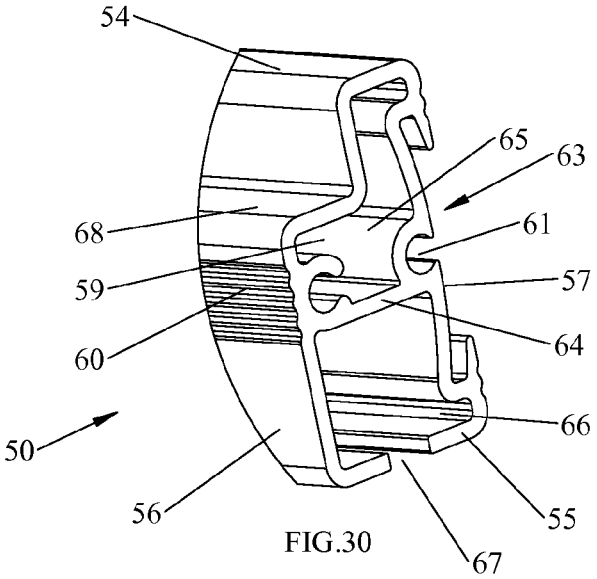
FIG. 30 illustrates a front, perspective, close-up view of an embodiment of the cross bar illustrated in FIG. 1.
Figure 31:
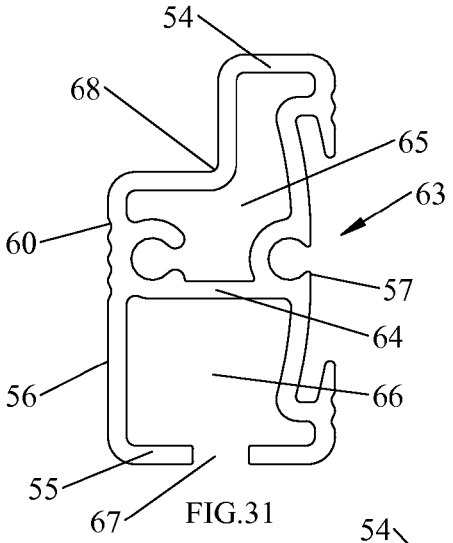
FIG. 31 illustrates a front, close-up view of the cross bar illustrated in FIG. 30.
Figure 32:
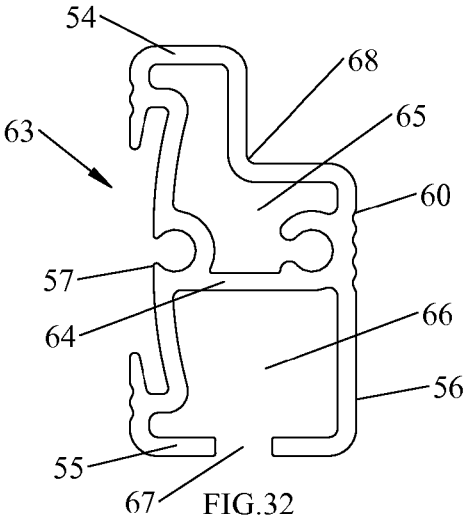
FIG. 32 illustrates a rear, close-up view of the cross bar illustrated in FIG. 30.

FIG. 30 illustrates a front, perspective, close-up view of an embodiment of the cross bar illustrated in FIG. 1 in accordance with an embodiment of the invention. FIGS. 31 and 32 illustrate front and rear close-up views of the cross bar illustrated in FIG. 30, respectively, in accordance with an embodiment of the invention. Referring to FIGS. 30-32, in an embodiment the hollow cross bar 50 comprises first and second distal ends (not shown) a top portion 54, a bottom portion 55, first and second side portions 56, 57, a support member 68, such as an indentation or ledge, extending longitudinally along the length of the exterior surface 60 of the cross bar 50, a track 63 on the second side of the cross bar 50 that is sized to receive an attachment (not shown), such as a decorative strip or panel (not shown), a bottom slot 67 extending longitudinally along the length of the bottom portion 55 of the cross bars 50 that is adapted to receive the cabinet component (not shown) for storing articles (not shown), and a cross bar divider 64 disposed within the cross bar 50, which extends between the interior surface 33 of the first and second side portions 56, 57 within the hollow cross bar 50 thereby dividing the cross bar 50 into two internal chambers—an upper chamber 65 and a lower chamber 66. The size of the lower chamber may be vertically adjustably adapted to accommodate different sized retainer rods of a cabinet component, including but not limited to standard cabinet components having a retaining rod, such as a hanger or a hanging cloth basket. Also in an embodiment, the upper chamber may have an L-shaped cross sectional area and the lower chamber may have a C-shaped cross sectional area. In an embodiment, the cross bar 50 comprises channel sections 61 that are sized to accommodate fasteners (not shown), for example two channel sections 61 disposed on the inner surface of the first side portion and the outer surface of the second side portion of the cross bar 50, respectively.

Figure 33:
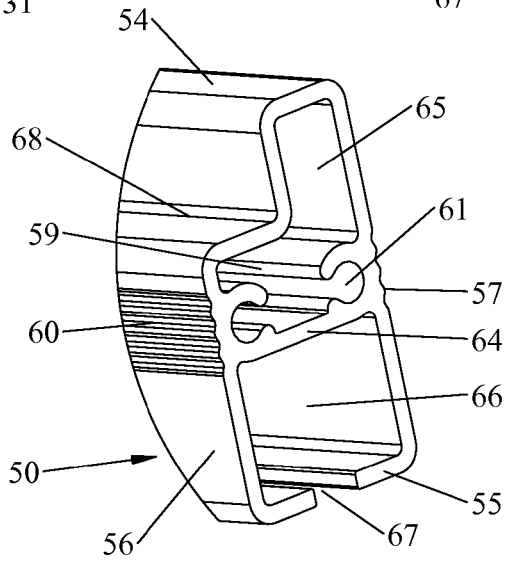
FIG. 33 illustrates a front, perspective, close-up view of the cross bar illustrated in FIG. 30 in accordance with an embodiment of the invention.
Figure 34:
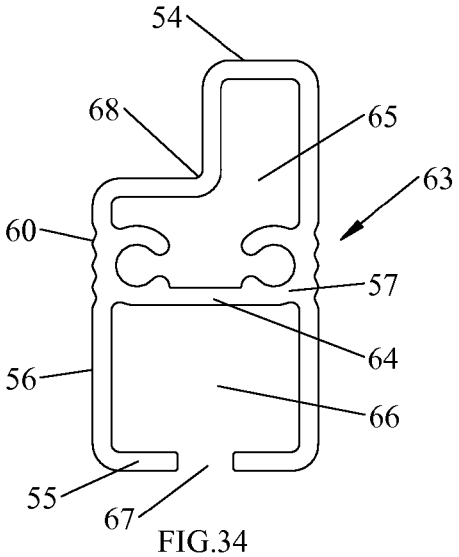
FIG. 34 illustrates a front, close-up view of the cross bar illustrated in FIG. 33.
Figure 35:
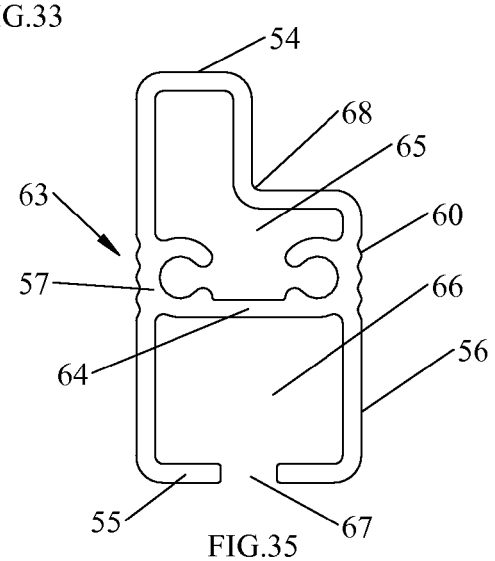
FIG. 35 illustrates a rear, close-up view of the cross bar illustrated in FIG. 33.
Figure 36:
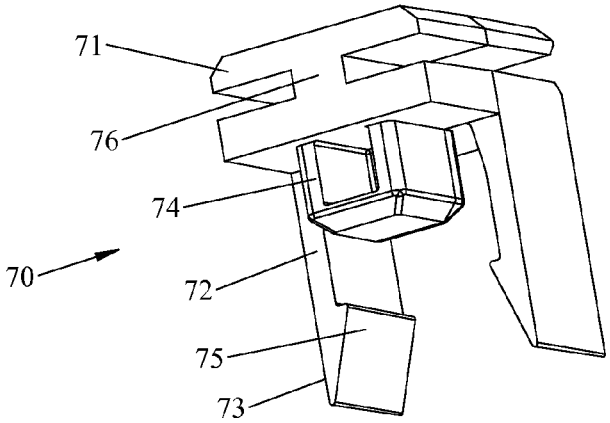
FIG. 36 illustrates a perspective view of the retainer clip used in the apparatus of FIG. 1 in accordance with an embodiment of the invention.
Figure 37:
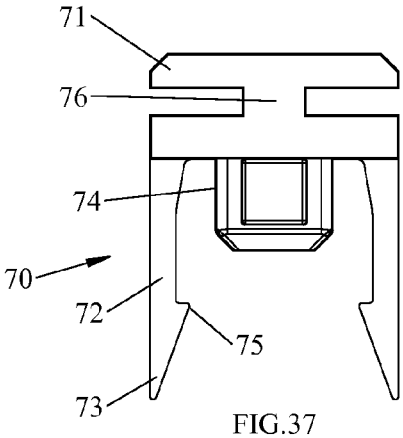
FIG. 37 illustrates a front view of the retainer clip of FIG. 36.
Figure 38:
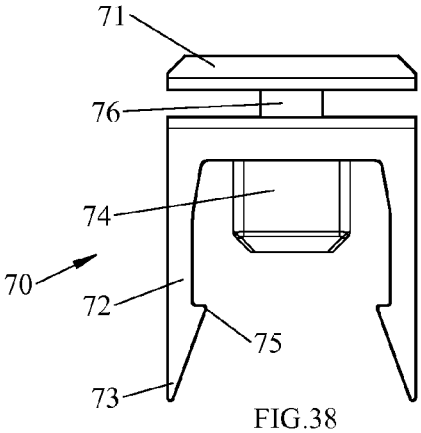
FIG. 38 illustrates a rear view of the retainer clip of FIG. 36.
Figure 39:
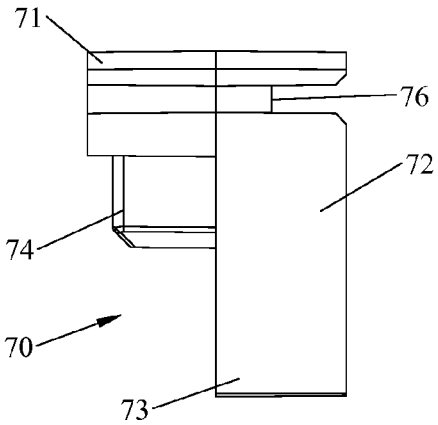
FIG. 39 illustrates a first side view of the retainer clip of FIG. 36.
Figure 40:
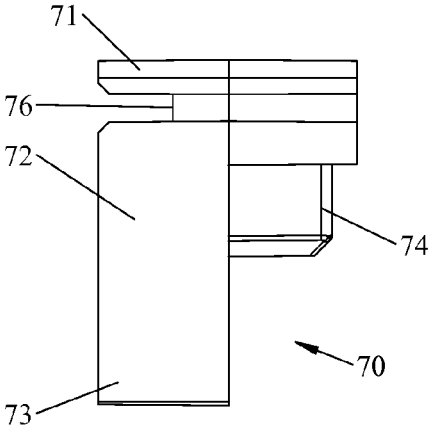
FIG. 40 illustrates a second side view of the retainer clip of FIG. 36.
Figure 41:
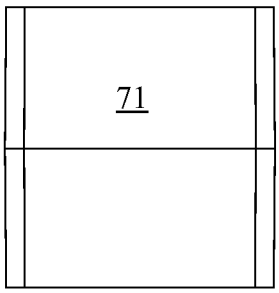
FIG. 41 illustrates a top view of the retainer clip of FIG. 36.

FIGS. 33-35 illustrate an embodiment of the cross bar of FIGS. 30-32 having only the support member 68 and bottom slot 67 and no track on the second side of the cross bar 50 for receiving an attachment, such as a decorative strip or panel.

The cross bar 50 may optionally have any combination of the support member 68, track 63, and/or bottom slot 67 for accommodating attachments (not shown). For example, in an embodiment, the cross bar 50 may include none of these features. Alternatively, the cross bar 50 may include a support member 68, a track 63, and a bottom slot 67 for accommodating attachments (not shown) or any combination thereof.

Figure 45:
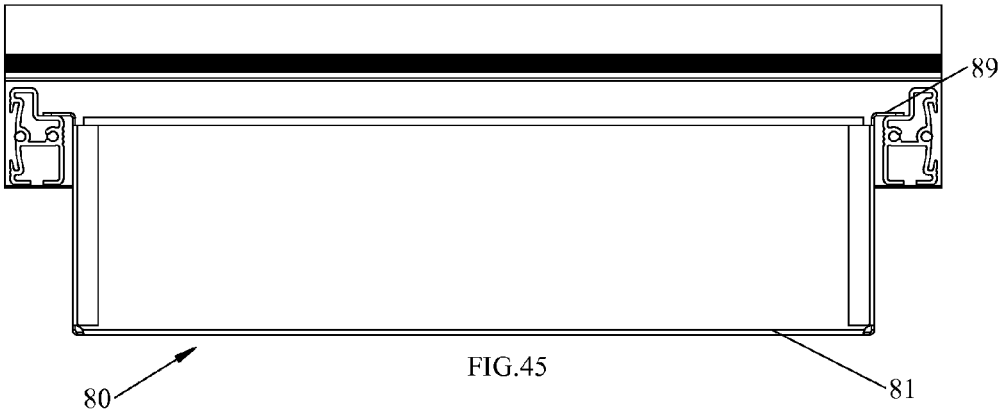
FIG. 45 illustrates a cross sectional front view of the apparatus of FIG. 1 taken along line I-I of FIG. 1 in use with a cabinet component in accordance with an embodiment of the invention.

In an embodiment, the support member 68 is adapted to receive the flange 89 (such as illustrated in FIG. 45) of a cabinet component 80 (such as illustrated in FIG. 45). Also in an embodiment, the cross bar comprises channel sections 61 that are sized to accommodate fasteners (not shown). The channel sections may be disposed on the first and second portions of the inner surface of the slide cover, or alternatively on the first portion of the inner surface of the slide cover and on the second portion of the outer surface of the slide cover.

FIGS. 36-42 and 43 illustrate perspective, front, rear, first side, second side, top, bottom, and bottom perspective views, respectively, of a retainer clip 70 used in the apparatus 10 of FIG. 1 accordance with an embodiment of the invention. The retainer clip 70 is used to secure the slide cover 30 to the slide in a selectively repeatable and releasable manner. Referring to FIGS. 36-40, in an embodiment, the retainer clip 70 comprises a head portion 71, prongs 72, and a peg 74. The head portion 71 has an I-shape and the prongs 72 project downward from the head portion 71. Each prong 72 has a wedge-shaped flange 75 at a distal end 73 of the prong 72. The neck 76 of the head portion 71 is configured to fit within the recess 43 of the slide cover divider (not shown) and the prongs 72 and the peg 74 are configured to fit within the slide (not shown) of the apparatus of FIG. 1. The peg portion 74 of the retaining clip 71 may comprise chamfers or a beveled edge for guiding the peg portion 74 into the slide 20 in order to facilitate insertion of the retainer clip 71 into the slide.

Figure 42:
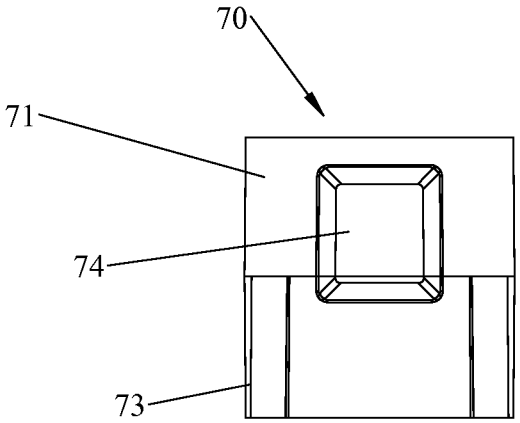
FIG. 42 illustrates a bottom view of the retainer clip of FIG. 36.
Figure 42A:
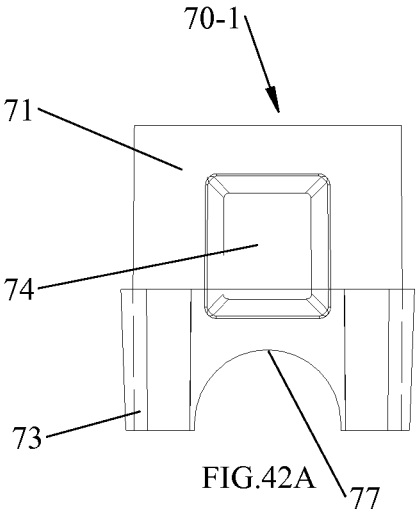
FIG. 42A illustrates a bottom view of a retainer clip according to an embodiment of the invention.
Figure 43:
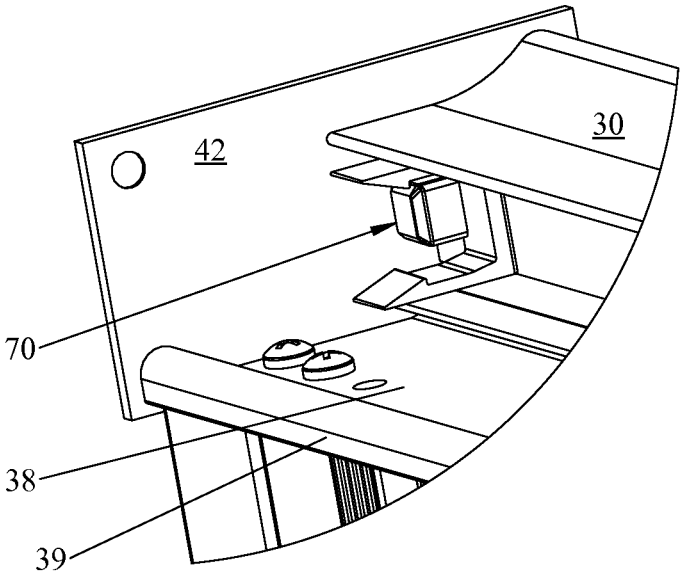
FIG. 43 illustrates the retainer clip of FIG. 36 used in the apparatus of FIG. 1 in accordance with an embodiment of the invention.

FIG. 42 A illustrates a bottom view of retainer clip 70-1. Retainer clip 70-1 is similar to retainer clip 70 except retainer clip 70-1 has screw recess 77 or notch where the head portion 71 is connected to prong 72. Screw recess 77 is sized to accommodate the head portion of fastener 95 and to provide access to through holes 49, 92. In some embodiments screw recess 77 may be a through hole sized to accommodate the head portion of a fastener 95.

Figure 44:
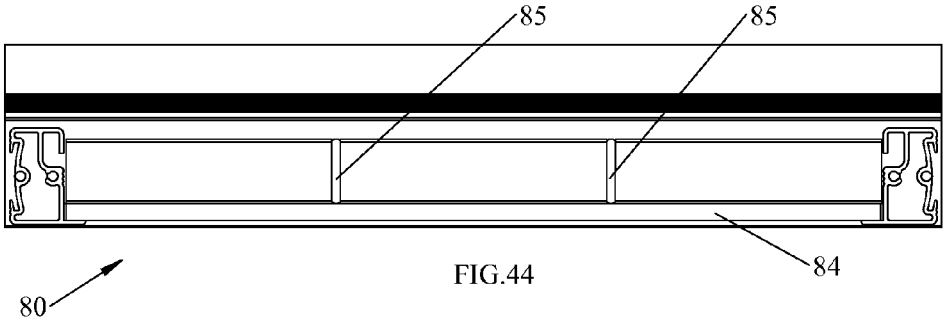
FIG. 44 illustrates a cross sectional front view of the apparatus of FIG. 1 taken along line I-I of FIG. 1 in use with a cabinet component in accordance with an embodiment of the invention.
Figure 46:
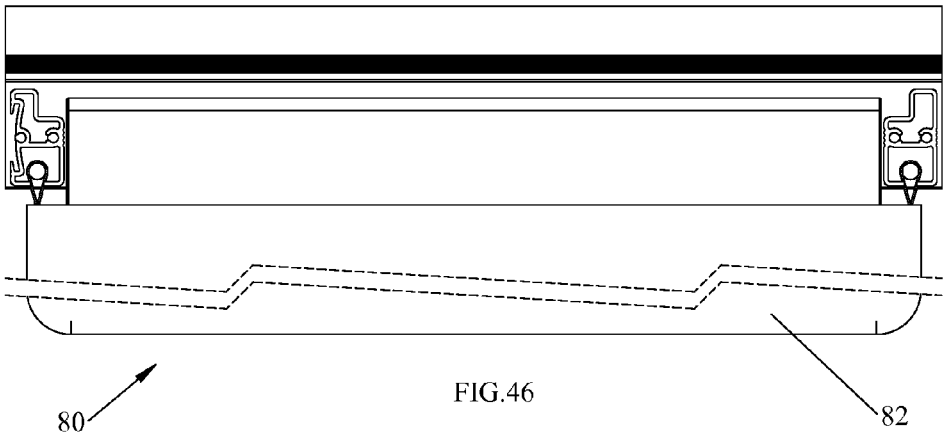
FIG. 46 illustrates a cross sectional front view of the apparatus of FIG. 1 taken along line I-I of FIG. 1 in use with a cabinet component in accordance with an embodiment of the invention.

FIGS. 44-46 illustrate a cross sectional front view of the unit organizer apparatus 10 of FIG. 1 taken along line I-I of FIG. 1 in use with a cabinet component 80 in accordance with an embodiment of the invention. The unit organizer apparatus 10 may be used with various cabinet components 80 as discussed above. In an embodiment, the cabinet component 80 may comprise a shelf 84, as illustrated in FIG. 44. The shelf may optionally be used with or without dividers 85, which divide the shelf space into discrete sections in order to provide additional flexibility for separating articles that are stored in the unit organizer apparatus 10, such as jewelry, accessories, or the like. In an embodiment, the cabinet component 80 may comprise a tray 81 for storing articles. The cross bar may comprise a lip or indentation for accommodating a cabinet component feature, such as a flange 89 on the tray 81, in order to support the tray 81 on the unit organizer apparatus 10. Also in an embodiment, the cabinet component 80 may comprise a basket 82, such as a hanging wire, wicker, or cloth basket, for storing articles such as clothing, socks, accessories, or the like. The basket 82 may be secured to the cross bar member by retaining rods attached to the basket 82 that mate with the lower chamber 66 of the cross bar 50 through the slot, as discussed above.

Figure 47:
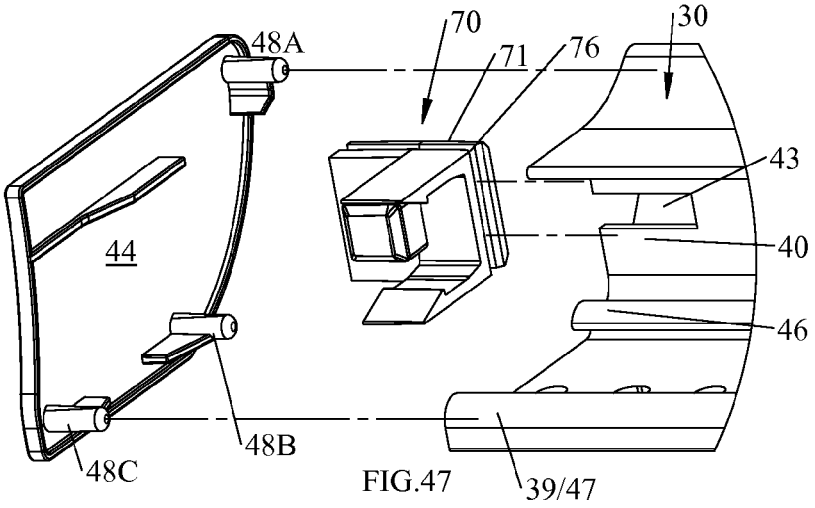
FIG. 47 illustrates an exploded, close-up view of the end cap, the retainer clip and the slide cover of FIG. 1 in accordance with an embodiment of the invention.
Figure 48:
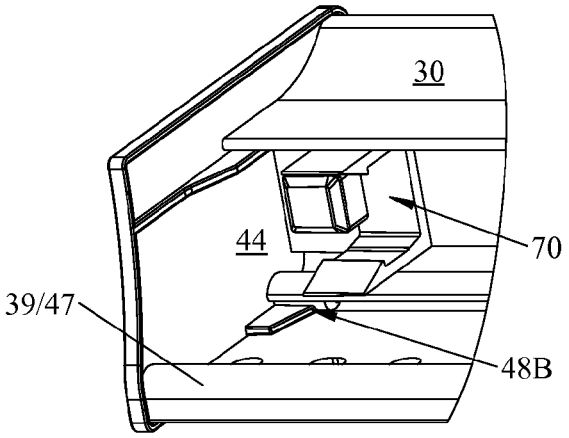
FIG. 48 illustrates a perspective view of the retainer clip of FIG. 36 used in the apparatus of FIG. 1 in accordance with an embodiment of the invention.
Figure 49:
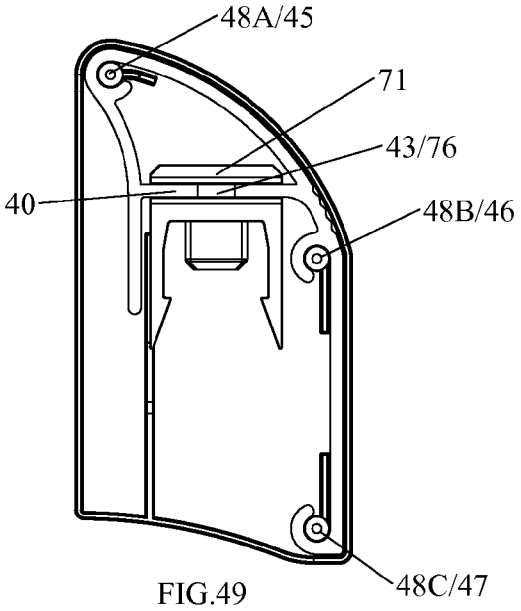
FIG. 49 illustrates an end view of the retainer clip of FIG. 36 used in the apparatus of FIG. 1 in accordance with an embodiment of the invention with the end cap removed for clarity.

FIGS. 47-49 illustrate views of end cap 44, retainer clip 70, and slide cover 30 of the apparatus shown in FIGS. 1 and 5 in accordance with one embodiment of the invention. As referenced previously above, the neck 76 of retainer clip 70 has been configured to slideably insert into recess 43 of slide cover divider 40. When the retainer clip 70 is inserted into recess 43, retainer clip 70 is partially held in place (such as against forces perpendicular to the insertion) by the slide cover divider 40 abutting against the head portion 71 of the retainer clip 70. Retainer clip 70, is securely fastened to slide cover 30 by end cap 44. In one embodiment, end cap 44 has projections 48A, 48B, 48C which are configured to be inserted in the upper screw channel 45, middle screw channel 46, and lower screw channel 47 of slide cover 30. In some embodiments, end cap 44 may be permanently attached to slide cover 30 using any known method or device known in the art for affixing structural members to one another, including but not limited to a weld or an adhesive attachment such as epoxy for example.

Figure 51:
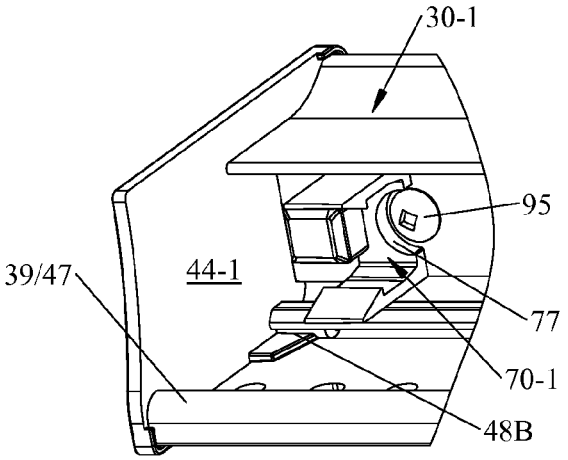
FIG. 51 illustrates a perspective view of the FIG. 50 apparatus in accordance with an embodiment of the invention.
Figure 52:
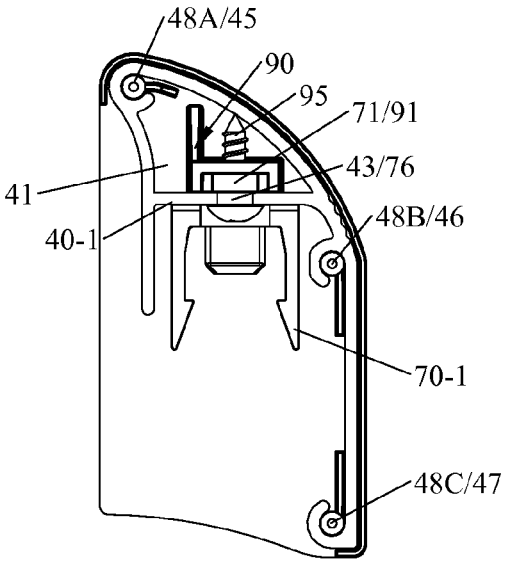
FIG. 52 illustrates an end view of the FIG. 50 apparatus in accordance with an embodiment of the invention.

FIGS. 50-52 illustrate views of end cap 44-1, retainer clip 70-1, and slide cover 30-1 in accordance with one embodiment of the invention. Slide cover 30-1 is similar to slide cover 30 except slide cover 30-1 has at least one through hole 49 located along the slide cover divider 40. Through hole 49 may be threaded or unthreaded and is sized to receive a fastener 95 such as a screw.

End cap 44-1 is similar to end cap 44 except end cap 44-1 has an additional tang 90. Tang 90 is configured to fit, and slideably insert, between the slide cover divider 40-1, the first side portion and the second side portion of slide cover 30-1 (also referred to as the slide cover chamber 41). As shown in FIG. 50, tang 90 extends substantially perpendicularly from the interior surface of the end cap 44-1.

In some embodiments, tang 90 has a hole 91 sized to receive the distal end of the head portion 71 of retainer clip 70-1 such that neck 76 of retainer clip 70 extends beyond the outer edge of hole 91. In some embodiments, tang 90 has a through hole 92. Through hole 92 may be threaded or unthreaded and is sized to accommodate, or receive, a fastener 95, such as a screw. As shown in FIG. 51, the distance of through hole 92 from the interior surface of end cap 44-1 is the same distance as the through hole 49 to the distal end of slide cover 30-1 such that when the interior surface of end cap 44-1 abuts the distal end of slide cover 30-1, through hole 92 and through hole 49 will align to receive fastener 95. Referring to FIG. 50, end cap 44-1 has projections 48A, 48B, 48C to align end cap 44-1. In some embodiments, end cap 44-1 may be permanently attached to slide cover 30-1 using any known method or device known in the art for affixing structural members to one another, including but not limited to a weld or an adhesive attachment such as epoxy, for example. In some alternative embodiments, end cap 44-1 will only have a tang 90, that is, without projections 48A, 48B, 48C.

FIG. 51 and FIG. 52 illustrate a perspective and end view of an embodiment of the invention depicting end cap 44-1, retainer clip 70-1, and slide cover 30-1. The distal end of head portion 71 of the retainer clip 70-1 is placed into hole 91 of end cap 44-1, the combined end cap 44-1 and retainer clip 70-1 is then slidably inserted into slide cover 30-1. When end cap 44-1 and retainer clip 70-1 is inserted into slide cover 30-1, projections 48A, 48B and 48C have been inserted into screw chamber 45, 46, and 47, tang 90 has been inserted into the slide cover chamber 41 and retainer clip neck 76 has been inserted into slide cover divider recess 43. When the interior surface of the end cap 44-1 abuts the distal end of the slide cover 30-1 through hole 92 of end cap 44-1, through hole 49 of slide cover 30A and screw recess 77 align to receive a fastener 95. In an embodiment, a fastener 95, including but not limited to a threaded screw, engages an unthreaded screw hole 92 and screw hole 49 in order to secure the end cap 44-1 to slide cover 30-1, such that the screw hole 92 and screw hole 49 self-threads upon insertion of the threaded fastener 95.

Figure 53:
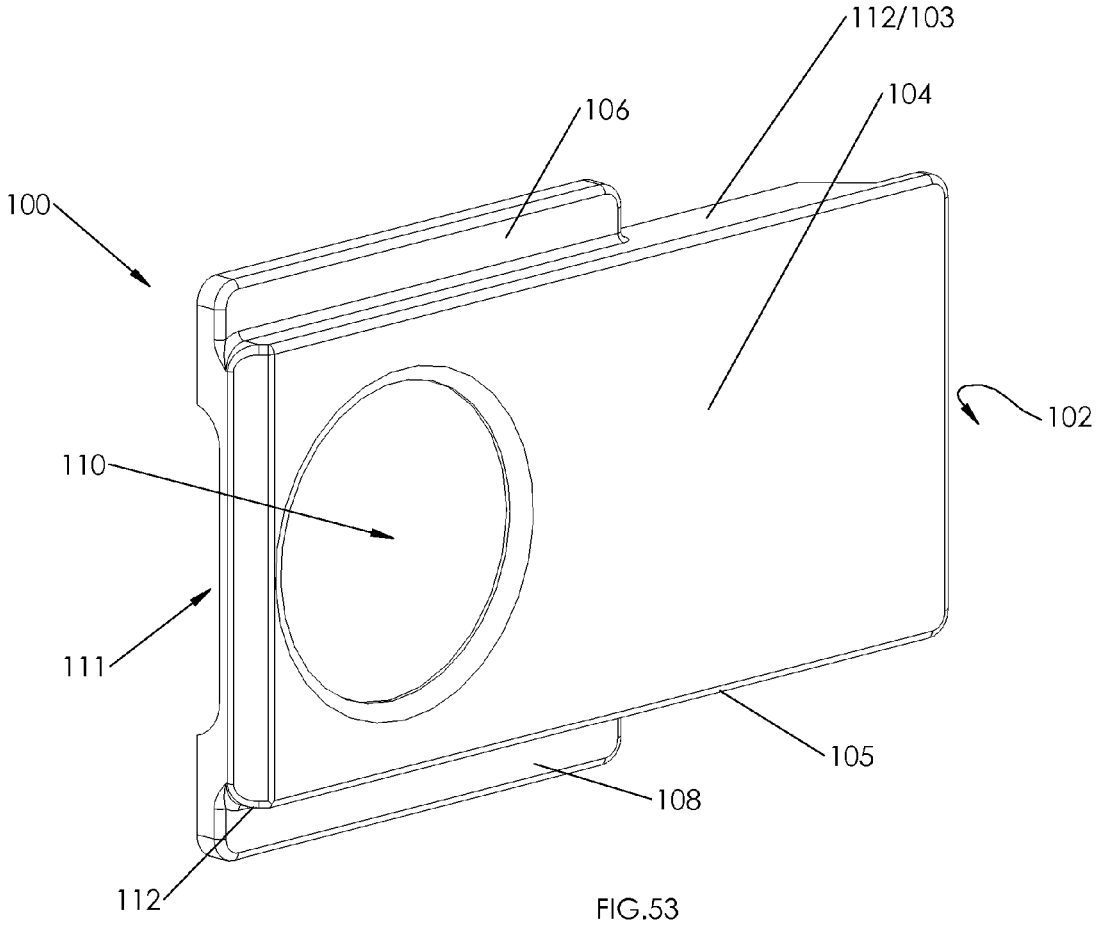
FIG. 53 is a perspective view of a retainer clip blocking plate in accordance with an embodiment of the invention.
Figure 54:
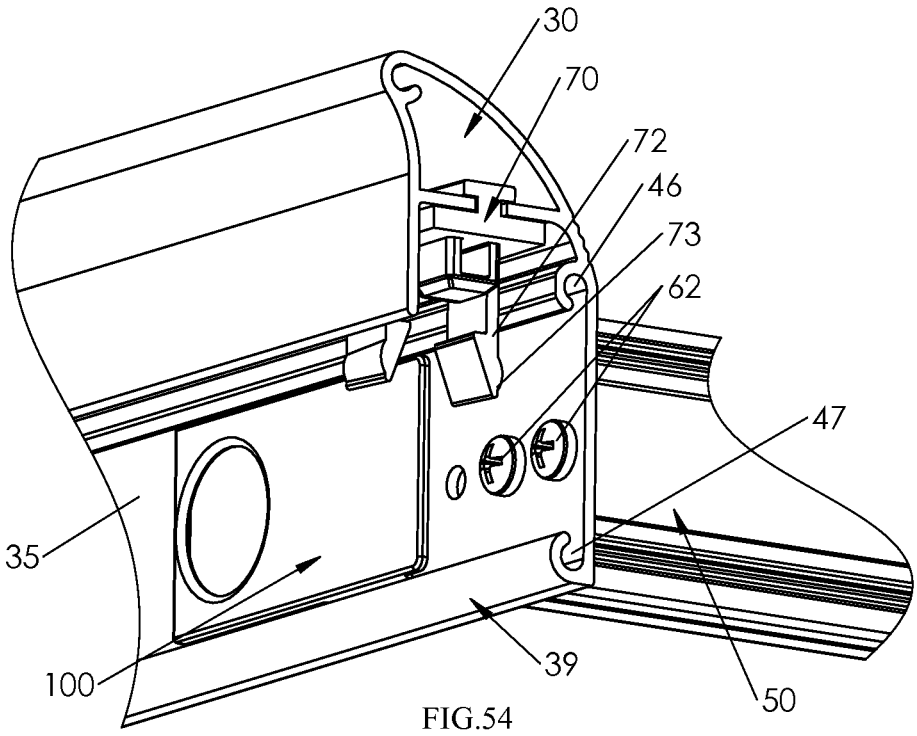
FIG. 54 is a perspective view of the FIG. 47 or FIG. 50 apparatus with a retainer clip blocking plate in a disengaged position in accordance with an embodiment of the invention.

FIG. 53 illustrates a perspective view of a retainer clip blocking plate 100 according to an embodiment of the invention. Retainer clip blocking plate, or simply blocking plate 100 has an interior surface 102, exterior surface 104, top portion 103, and bottom portion 105. Stands 112 extends substantially perpendicularly from interior surface 102. In some embodiments, stands 112 extends substantially continuously adjacent the top 103 and bottom 105 portion, respectively. Stands 112 may extend a distance covering between 50-100% of the length of the top 103 and bottom 105 portion. In some embodiments, stands 112 may comprise a plurality of protrusions extending perpendicularly from the interior surface 102. In one embodiment, stands 112 have a clearance or depth (measured from the distal end of stands 112, the point that is the greatest distance away from interior surface 102, to interior surface 102) greater than the length of the head portion of one or more fasteners 62 engaged in a slide cover 30, as illustrated in FIG. 54. Stands 112 may desirably provide clearance so that blocking plate 100, or a portion thereof, may slide over the head portions of one or more fasteners 62.

In some embodiments, stands 112 may comprise a rim or collar extending perpendicularly from the outer edge of the interior surface 102. In some embodiments, stands 112 may extend perpendicularly from the outer edge of the interior surface between the top 103 and bottom 105 surfaces. In some embodiments, and as shown in FIG. 53, stands 112 comprises a cutaway 111, or recess. In some embodiments, stands 112 may be cut away or otherwise removed or recessed to form cutaway 111. In some embodiments, stands 112 may be produced, by casting, extrusion molding or the like, such that a recess 111 exists. In one such embodiment, cutaway 111 is sized to permit clearance between the end of cutaway 111 and the distal end of the head of one or more fastener 62.

In some embodiments, flanges 106, 108 extend, in a parallel direction, lengthwise along the stands 112 of blocking plate 100. Flanges 106, 108 may extend a distance covering between 20-100% of the length of blocking plate 100 and stands 112. In a particular such embodiment, as shown in FIG. 53, flanges 106, 108 extend approximately 50-60% of the length of blocking plate 100 and stands 112. The width of flanges 106, 108 may be configured and sized to be slideably inserted into slide cover flange 39 of slide cover 30 through the middle 46 and lower 47 screw channel of slide cover 30, as illustrated in FIG. 54.

Figure 55:
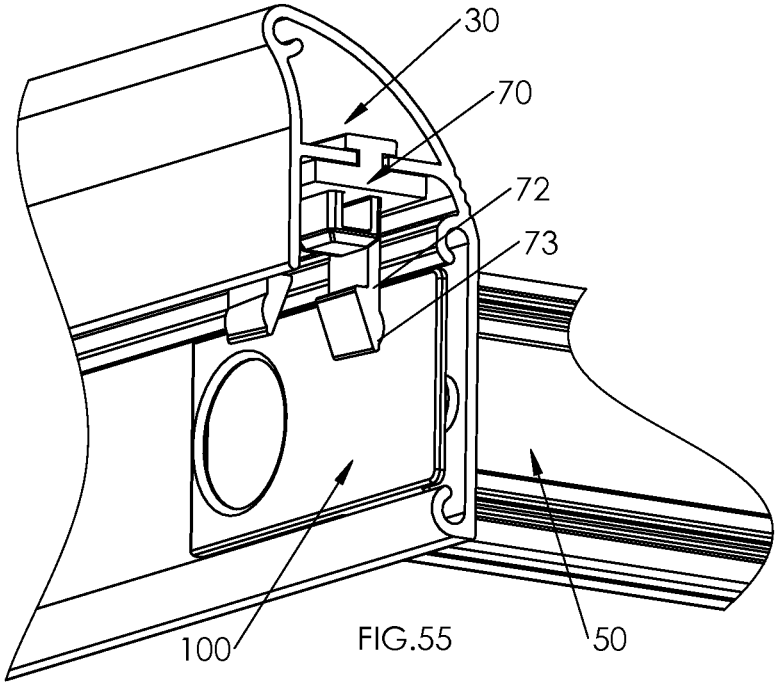
FIG. 55 is a perspective view of the FIG. 47 or FIG. 50 apparatus with a retainer clip blocking plate in an engaged position in accordance with an embodiment of the invention.

FIGS. 54 and 55 illustrate perspective views of the FIG. 47 or FIG. 50 apparatus with a retainer clip blocking plate in a disengaged position (FIG. 54) and engaged position (FIG. 55) with respect to a slide cover 30, in accordance with exemplary embodiments of the invention. Blocking plate 100 may be slidably inserted along a first side portion 35 of slide cover 30. As described above, flanges 106 and 108 may be slidably received into middle and lower screw channels 46, 47. Fasteners 62 may optionally be installed in through hole 32 of slide cover 30 while blocking plate 100 is slidably received into slide cover 30. In embodiments where fastener(s) 62 are installed in through hole 32, cutaway 111 may desirably permit the interior surface 102 of blocking plate 100 to slide over the head of fastener(s) 62.

Figure 56:
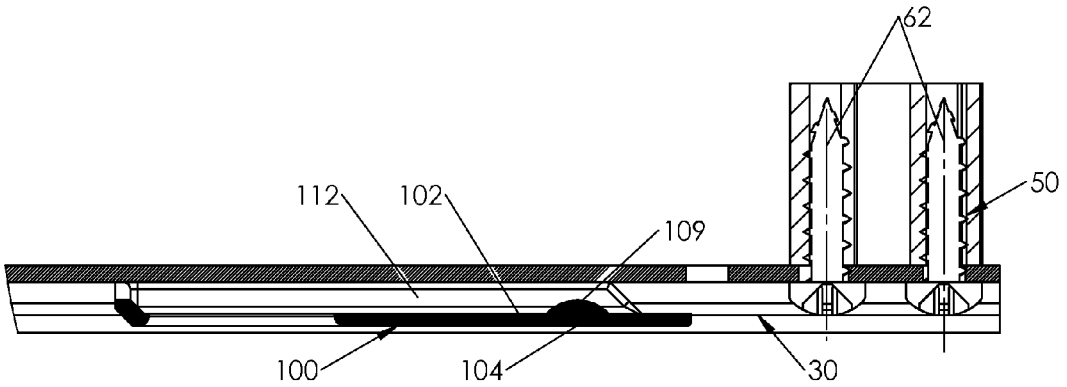
FIG. 56 is a cross sectional side view of the FIG. 54 apparatus with a retainer clip blocking plate in a disengaged position in accordance with an embodiment of the invention.
Figure 57:
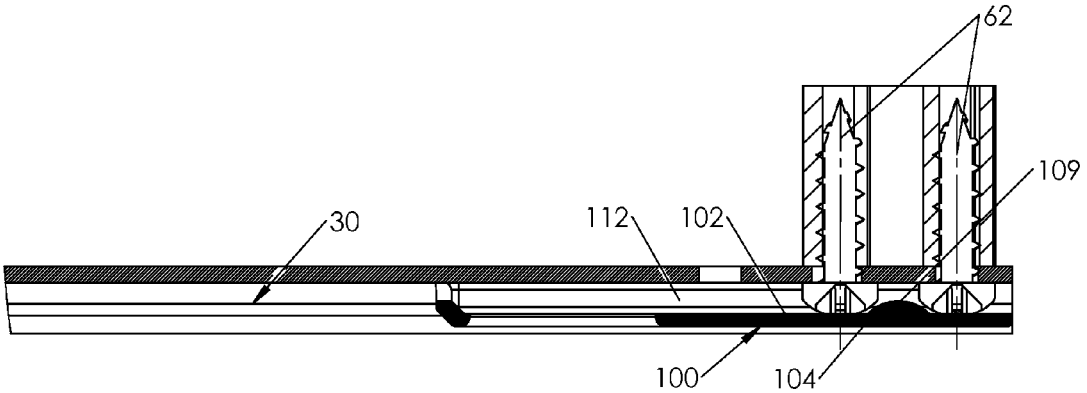
FIG. 57 is a cross sectional side view of the FIG. 55 apparatus with a retainer clip blocking plate in an engaged position in accordance with an embodiment of the invention.

FIGS. 56 and 57 illustrate cross sectional side views of the FIG. 54 apparatus with a retainer clip blocking plate in a disengaged position (FIG. 56) and in an engaged position (FIG. 57) in accordance with an embodiment of the invention. As shown in FIGS. 56 and 57, blocking plate 100 has a latching protrusion or latch 109 extending substantially perpendicularly from the interior surface 102. Latch 109 may be a semi-circular or other rounded protrusion extending from the interior surface 103. In some embodiments, latch 109 may be a triangle, or other geometric protruding shape. The length of latch 109 is configured and sized to slidably engage with or between the heads of fastener(s) 62. In one such embodiment, latch 109 engages one or more of fasteners 62 by forceably sliding over the head of fastener 62 to catch in place on the other side of the head or fastener 62, for example. Accordingly, blocking plate 100 may be slideably engaged and disengaged by applying a force parallel to slide cover 30 towards fastener 62. In some embodiments, blocking plate 100 has a finger aperture 110 that aids the user in applying a parallel force to engage and disengage blocking plate 100.

FIGS. 55 and 57 depict blocking plate 100 in an engaged position covering the heads of fastener(s) 62 according to an embodiment. FIG. 54 and FIG. 56 depict the blocking plate 100 in a disengaged position. In one embodiment, in an engaged position, latch 109 sits in between fasteners 62. As shown in FIG. 55, when the blocking plate 100 is engaged, the exterior surface 104 adjacently opposes the distal end 73 of one of the prongs of the retainer clip 70. Accordingly, when the blocking plate 100 is in an engaged position, prongs 72 of retainer clip 70 will retain slide 20 (not shown) and the slide 20 may not be disengaged unless the blocking plate 100 is slidably disengaged.

In an embodiment, the apparatus of the present invention may comprise a kit used for the customizable storage unit organizer apparatus 10 of FIG. 1. The kit may comprise pieces of the apparatus 10, as illustrated in FIG. 3, namely a pair of slides 20, a slide cover 30, a hollow cross bar 50, a retainer clip 70 for selectively, repeatedly, and releasably retaining the slide covers 30 to the slides 20, and a cabinet component (not shown), such as a bin, tray, shelf, or other container, for storing articles on the apparatus. In some embodiments, the kit may further comprise retainer clip blocking plate 100.

In an embodiment, the slide cover may be one long, single slide cover piece (not shown) and a pair of slide covers 30*a*, 30*b* may be cut from this single slide cover piece. A series of holes are then punched along the length of the slide cover, as discussed above, for accommodating different attachment positions for the cross bars.

The hollow cross bar 50 may be one long, single hollow cross bar piece (not shown) or alternatively a pair of cross bars 50*a*, 50*b* cut from the single cross bar piece. Multiple slide covers and cross bars may be cut from one long slide cover piece and cross bar piece, respectively, such that slide covers and cross bars used for each side of the apparatus 10 may be manufactured from single pieces of slide covers and cross bars. This reduces the need to manufacture separate, different slide covers and cross bars for each side of the apparatus, and therefore reduce manufacture, transport, and storage costs associated with the apparatus.

In an embodiment, a method of assembling the customizable storage unit organizer apparatus 10, as discussed above, comprises providing a customizable storage unit organizer apparatus 10 kit, as discussed above, manufacturing a pair of sub-slide covers 30*a*, 30*b* from a single slide cover piece, each sub-slide cover comprising equal lengths as one another. The method may also comprise the step of manufacturing a pair sub-cross bars 50*a*, 50*b* from the single hollow cross bar piece, each sub-cross bar comprising equal lengths as one another, arranging the pair of sub-cross bars 50*a*, 50*b* in a parallel configuration, arranging the position of one of pair of the sub-slide covers 30*a* on one end of the parallel configuration such that they intersect the sub-slide cover 30*a* at a right angle, arranging the position of the other sub-slide cover 30*b* at another end of the parallel configuration such that the pair of sub-cross bars 50*a*, 50*b* intersect the other sub-slide covers 30*a*, 30*b* at right angles. The method also comprises the step of fastening the pair of sub-cross bars 50*a*, 50*b* to the pair of sub-slide covers 30*a*, 30*b*, forming an enclosure 15 between the pair of sub-cross bars 50*a*, 50*b* and the pair of sub-slide covers 30*a*, 30*b*, placing a retainer clip 70 into the recess 43 on the divider of each of the slide covers 30*a*, 30*b*, locating the recess 43 at the opposite end of the covers 30 on the tab 22 on the top portion of the slide 20, then rotating the cover 30 downwards and snapping the pair of sub-slide covers 30 into in pair of slides 20, and customizing the size of the enclosure 15 by changing the positions of the pair of sub-cross bars along the length of the slide members, and affixing them to the covers 30. The retainer clip 70 permits some movement such that sizing is not an issue when installing the organizer unit 10 on slides and arrangements of slightly different dimensions, as occurs in the field. This is achieved as the tab 22 is not fixed to the cover 30 nor is the retainer clip 70 affixed to the cover 30, permitting movement between these components. This method permits the easy installation in situ of organizer units 10 customized to fit any cabinet size using a minimum of material in the form of extruded cover 30 and bar 50 components, decreasing the stocking needs for a cabinet organizing company.

In addition, this method of assembling the customizable storage unit organizer apparatus 10 may also comprise an additional step of re-customizing the storage unit organizer apparatus 10, for example, in order to modify the size or shape of the enclosure 15 formed between the slide covers 30 and cross bars by re-adjusting the positions of the cross bars along the longitudinal length of the slide members. Furthermore, this method may also comprise an additional step of re-customizing the storage unit by replacing the cabinet component with a second cabinet component.

The cabinet component may be any suitable container for holding articles, including but not limited to a container, a basket, a bin, a tray, a shelf, space dividers, or a planar surface.

In various embodiments herein described, end caps 44 and 44-1 may be interchangeably used, slide cover 30 and 30-1 may be interchangeably used, and the retainer clip 70 and 70-1 may be interchangeably used without explicit reference.

The exemplary embodiments herein described are not intended to be exhaustive or to limit the scope of the invention to the precise forms disclosed. They are chosen and described to explain the principles of the invention and its application and practical use to allow others skilled in the art to comprehend its teachings.

As will be apparent to those skilled in the art in light of the foregoing disclosure, many alterations and modifications are possible in the practice of this invention without departing from the scope thereof. Accordingly, the scope of the invention is to be construed in accordance with the substance defined by the following claims.

What is claimed is:

1. A customizable storage unit organizer apparatus having a plurality of slides, the apparatus comprising:

a plurality of slide covers disposed on top of the plurality of slides, each of the plurality of slide covers comprising first and second distal ends, exterior and interior surfaces, first and second side portions, a top portion, a bottom portion, and a slide cover divider extending between the first and second side portions, a plurality of cross bars extending between and affixed to the plurality of slide covers, each of the cross bars comprising first and second distal ends, an enclosure formed between the plurality of slide covers and plurality of cross bars, at least one cabinet component for storing articles within the enclosure, wherein the cross bars are horizontally adjustable along the length of the slide covers, and a plurality of retainer clips for selectively, repeatedly, and releasably retaining the plurality of slide covers to the plurality of slides, wherein each slide comprises a recess, each of the plurality of slide covers further comprises a slide cover slot, and the recess of the slide is configured to interact with the retainer clip.

2. The apparatus of claim 1, wherein the plurality of slide covers are affixed to the plurality of slides.

3. The apparatus of claim 1, additionally comprising an end cap with a substantially similar cross sectional shape to the slide covers, wherein the end cap abuts said distal end of said slide cover.

4. The apparatus of claim 3, wherein the end cap comprises a tang extending substantially perpendicularly from an interior surface of the end cap.

5. The apparatus of claim 4, wherein the tang comprises a first through hole and the slide cover divider comprises a second through hole, wherein the first and second through holes are sized to accommodate a fastener.

6. The apparatus of claim 5, wherein the end cap is removeably affixed to the distal end of said slide cover by inserting a fastener through the second through hole of said slide cover divider and the first through hole of said tang.

7. The apparatus of claim 6, further comprising a plurality of retainer clips for selectively, repeatedly, and releaseably retaining the plurality of slide covers to the plurality of slides, wherein each retainer clip of the plurality of retainer clips comprises a head portion comprising a top portion, a bottom portion and an I-shape, the I-shape comprising a neck portion, wherein the neck is configured to fit within the slide cover slot.

8. The apparatus of claim 7, wherein the bottom portion of each retainer clip of the plurality of retainer clips comprises a recess.

9. The apparatus of claim 7, wherein the tang comprises a hole sized to receive the top portion of said retainer clip.

10. The apparatus of claim 4, wherein the tang is configured to fit between the slide cover divider, the first side portion and the second side portion.

11. The apparatus of claim 1, wherein a face plate is attached to a first distal end of each slide cover and is adapted to receive a fascia board along the length of the cross bar between the first distal ends of the slide covers.

12. The apparatus of claim 1, further comprising channel sections disposed on the first and second portions of the cross bars, the channel sections being sized to accommodate fasteners.

13. The apparatus of claim 1, further comprising a track extending longitudinally along the length of the exterior surface of each of the cross bars for accommodating attachments.

14. The apparatus of claim 1, wherein the cross bars are hollow and comprise first and second side portions, and further comprising a cross bar divider extending between interior surfaces of the first and second side portions within the hollow cross bars thereby forming lower and upper chambers.

15. The apparatus of claim 14, wherein the lower chamber comprises a cross sectional area having a C-shape, and a slot extending longitudinally along the length of a bottom portion of the cross bars adapted to receive the cabinet component for storing articles.

16. The apparatus of claim 14, wherein the upper chamber comprises a cross sectional area having an L-shape.

17. The apparatus of claim 1, wherein the cabinet component is selected from the group consisting of a container, a basket, a bin, a tray, a shelf, space dividers, and a planar surface.

18. The apparatus of claim 1, wherein each retainer clip of the plurality of retainer clips comprises a head portion comprising a top portion, a bottom portion, and an I-shape, at least one prong projecting downward from the bottom portion, each prong comprising a wedge-shaped flange at a distal end of the prong, and a peg, wherein the neck is configured to fit within the slide cover slot, and the at least one prong and the peg are configured to fit within the slide.

19. The apparatus of claim 18, further comprising channel sections disposed on the first portions of the slide covers, the channel sections sized to accommodate fasteners.

20. The apparatus of claim 19, further comprising a blocking plate, the blocking plate comprising an interior surface, an exterior surface, a latch, a first flange extending longitudinally along a first edge between the interior and exterior surface, and a second flange extending longitudinally along a second edge between the interior and exterior surface wherein the second edge is parallel to the first edge; and the latch protruding from the interior surface;

wherein the first and second flange are configured to be slideably insertable in the channel sections.

21. The apparatus of claim 20, wherein the plurality of cross bars are affixed to the plurality of slide covers with a fastener.

22. The apparatus of claim 21, wherein the latch abuts said fastener, and wherein the exterior surface of said blocking plate is adjacently opposing a distal end of the at least one prong.

23. The apparatus of claim 19, the blocking plate further comprising an aperture.

24. The apparatus of claim 1, wherein the plurality of cross bars are affixed to the plurality of slide covers through a connector selected from the group consisting of a fastener, a weld, or an epoxy.

25. The apparatus of claim 1, further comprising face plates configured to be affixed to the distal ends of the slide covers.

26. The apparatus of claim 1, further comprising a support member extending longitudinally along the length of the cross bars for supporting the cabinet component, wherein the cabinet component comprises a flange, and the support member is adapted to receive the flange of a cabinet component for supporting the cabinet component.

27. The apparatus of claim 26, wherein the support member comprises a lip extending longitudinally along the length of bottom portion of the exterior surface of the cross bars for supporting the cabinet component.

28. The apparatus of claim 26, wherein the support member comprises an indentation extending longitudinally along the length of top portion of the cross bars for supporting the cabinet component.

29. The apparatus of claim 28, further comprising a flange affixed to the top portion of the cross bar and extending over the indentation.

30. A customizable storage unit organizer apparatus having a plurality of slides, the apparatus comprising:

a plurality of slide covers disposed on top of the plurality of slides, each of the plurality of slide covers comprising first and second distal ends, exterior and interior surfaces, first and second side portions, a top portion, a bottom portion, and a slide cover divider extending between the first and second side portions, a plurality of cross bars extending between and affixed to the plurality of slide covers, each of the cross bars comprising first and second distal ends, an enclosure formed between the plurality of slide covers and plurality of cross bars, at least one cabinet component for storing articles within the enclosure, and a support member extending longitudinally along the length of the cross bars for supporting the cabinet component, wherein the cabinet component comprises a flange, and the support member is adapted to receive the flange of a cabinet component for supporting the cabinet component, wherein the cross bars are horizontally adjustable along the length of the slide covers, and wherein the support member comprises an indentation extending longitudinally along the length of top portion of the cross bars for supporting the cabinet component.

* * * * *